US007731112B2

(12) United States Patent
Matlin et al.

(10) Patent No.: US 7,731,112 B2
(45) Date of Patent: Jun. 8, 2010

(54) UNDERSIDE PARTICLE FLAP FOR SHREDDER

(75) Inventors: Tai Hoon Kim Matlin, Round Lake Beach, IL (US); Scott Christopher Daigle, Westmont, IL (US); Art Gardner, Palatine, IL (US)

(73) Assignee: Fellowes, Inc., Itasca, IL (US)

( * ) Notice: Subject to any disclaimer, the term of this patent is extended or adjusted under 35 U.S.C. 154(b) by 0 days.

(21) Appl. No.: 12/166,000

(22) Filed: Jul. 1, 2008

(65) Prior Publication Data

US 2010/0001111 A1 Jan. 7, 2010

(51) Int. Cl.
*B02C 18/22* (2006.01)

(52) U.S. Cl. ..... 241/30; 241/100; 241/236

(58) Field of Classification Search ..... 241/100, 241/236, 36, 30
See application file for complete search history.

(56) References Cited

U.S. PATENT DOCUMENTS 4,650,128 A * 3/1987 Goldhammer ..... 241/36
7,040,559 B2 5/2006 Matlin
7,204,441 B1 4/2007 Hartnett
2008/0277511 A1 11/2008 Shen

FOREIGN PATENT DOCUMENTS

DE 20003291 U1 7/2001

OTHER PUBLICATIONS

British Search Report issued in GB Patent Application No. 090979038, mailed on Jul. 10, 2009.

* cited by examiner

*Primary Examiner*—Mark Rosenbaum
(74) *Attorney, Agent, or Firm*—Pillsbury Winthrop Shaw Pittman LLP

(57) ABSTRACT

Disclosed herein is a shredder having a closure located adjacent an output opening of a shredder housing that is selectively positioned to prevent shredded materials from being discharged from the output opening. The closure may be connected to the shredder housing, and the container may comprise a removable waste bin. The closure may be actuated via an actuator to a closed position in response to the container and the shredder housing being moved out of an operative position relative to each other, such as when the waste bin is being emptied. The closure may assist in reducing or eliminating waste from being distributed in or around the shredder.

17 Claims, 21 Drawing Sheets

UNDERSIDE PARTICLE FLAP FOR SHREDDER

BACKGROUND OF THE INVENTION

1. Field of Invention

The present invention is generally related to a shredder having cutter elements for shredding articles. In particular, the apparatus comprises a device for capturing shredded articles when a waste bin is removed.

2. Background

A common type of shredder has a shredder mechanism contained within a housing and mounted atop a container. The shredder mechanism typically includes a cutting head assembly including a series of cutter elements that shred articles such as paper, CDs, DVDs, credit cards, and the like that are fed therein and discharge the shredded articles downwardly through a discharge opening into the container. An example of such a shredder may be found, for example, in U.S. Pat. No. 7,040,559, which is herein incorporated by reference in its entirety.

When the container of the shredder is emptied, the cutter elements may have waste particles from the shredded articles caught within them, or they may be caught on the strippers located between the cutter elements. Paper shredders using cutting assemblies having stacked cutters and strippers may aggravate this problem even more so because their assembly is more prone to allowing waste particles to become wedged into these areas. When the waste bin or container is pulled out from beneath the shredder mechanism to be emptied, the action of moving or pulling on the bin or container may agitate the shredder and the waste particles stuck in the cutting assembly. Thus, dislodged waste particles may fall through the discharge opening to the bottom of the cabinet and/or onto the floor near the shredder. The creation of this mess of waste particles in, near or around the shredder is typical, known, and recognized as a consumer annoyance.

Some prior art shredders are known to provide mechanisms or flaps for safety reasons, e.g., to keep the user away from the sharp metal cutter elements, or as a bin full indication method. For example, U.S. Pat. No. 7,204,441 B1, issued Apr. 17, 2007 to the same assignee, and herein incorporated by reference in its entirety, describes a shredder apparatus with full bin indicator. More specifically, the '441 patent illustrates a flap that can be used for both safety purposes and as an indication that the waste bin is full of shredded materials. The flap of the '441 patent is hinged so that it can close over the opening if the head is tilted vertically. However, devices for helping reduce possible messes caused by waste particles when the bins or containers of the shredders are emptied are not known in the art.

SUMMARY OF THE INVENTION

One aspect of the invention provides a shredder having a container for receiving shredded materials; a shredder mechanism including a motor and cutter elements, the shredder mechanism enabling materials to be shredded to be fed into the cutter elements, and the motor operable to drive the cutter elements in a shredding direction so that the cutter elements shred materials fed therein. The shredder also has a shredder housing having the shredder mechanism mounted therein. The shredding housing has an input opening on an upper side for receiving materials to be shredded into the shredder mechanism, and an output opening on a lower side for discharging shredded materials from the shredder mechanism. The shredder housing is configured to be supported above the container such that the shredded materials are discharged through the output opening into the container. A closure is located adjacent the output opening. The closure is configured to be selectively positioned between an open position and a closed position, and allows shredded materials to be discharged from the output opening in the open position and prevents shredded materials from being discharged from the output opening in the closed position. An actuator is provided for moving the closure to the closed position in response to a predetermined operational condition of the shredder.

Another aspect of the invention a method for preventing shredded materials from being discharged from an output opening of a shredder. The shredder has a container for receiving shredded materials and a shredder housing supported above the container with a shredder mechanism mounted therein. The shredder mechanism has an input opening on an upper side for receiving materials to be shredded and the output opening on a lower side for discharging shredded materials into the container. The method includes: moving a closure with an actuator from an open position to a closed position in response to a predetermined operational condition of the shredder, wherein the closure allows shredded materials to be discharged from the output opening in the open position and prevents shredded materials from being discharged from the output opening in the closed position.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

The following embodiments are described with reference to the drawings and are not to be limiting in their scope in any manner.

Figure 1:
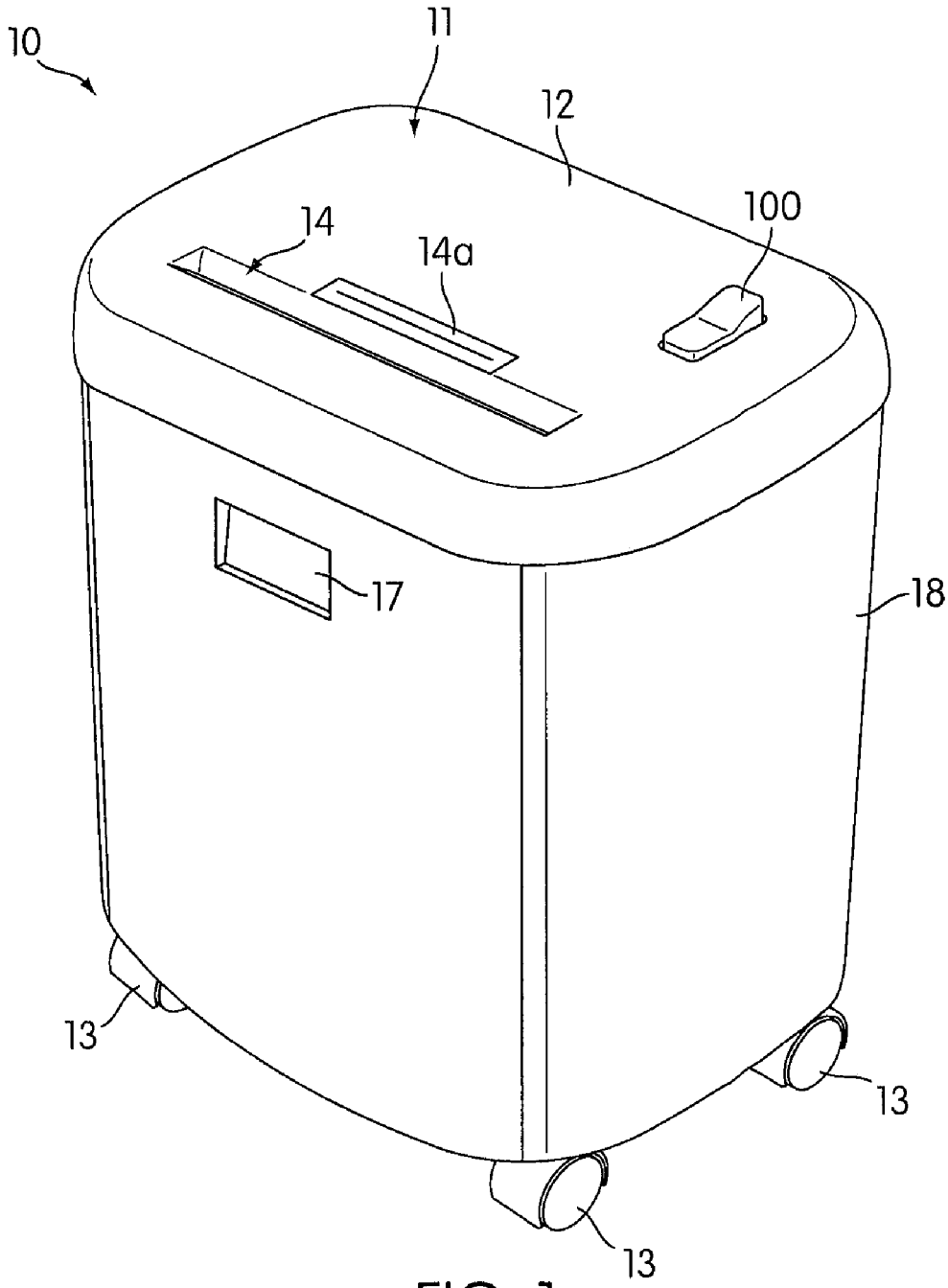
FIG. 1 is a top perspective view of a shredder apparatus used with a closure in accordance with an embodiment of the present invention.

FIG. 1 is a top perspective view of a shredder apparatus 10 used with a closure device in accordance with an embodiment of the present invention. Generally speaking, the shredder 10 may have any suitable construction or configuration and the illustrated embodiments provided herein are not intended to be limiting in any way. The shredder 10 is designed to destroy or shred articles such as paper, paper products, CDs, DVDs, credit cards, and other objects. In an embodiment, the shredder 10 may comprise wheels 13 to assist in moving the shredder 10. The shredder 10 comprises a shredder housing 12 that is configured to be mounted on top of a frame 18, for example. The shredder housing 12 comprises at least one input opening 14 on an upper side 11 (or top side) of the housing 12 for receiving materials to be shredded, and an output opening 16 on a lower side 15 (or bottom side or underside or bin side). In an embodiment, an additional or second input opening 14*a* may be provided in shredder housing 12. For example, input opening 14 may be provided to receive paper, paper products, and other items, while second input opening 14*a* may be provided to receive objects such as CDs and DVDs. In addition, the term "shredder" or "shredder apparatus," used interchangeably throughout this specification, are not intended to the limited to devices that literally "shred" documents and articles, but instead intended to cover any device that destroys documents and articles in a manner that leaves such documents and articles illegible and/or useless.

The shredder 10 also comprises a shredder mechanism 20 (as shown as a hidden object in FIG. 3 and in FIG. 7*c*) in the shredder housing 12. When articles are inserted into the input opening 14 or 14*a*, they are directed toward and into shredder mechanism 20. "Shredder mechanism" is a generic structural term to denote a device that destroys articles using at least one cutter element. Destroying may be done in any particular way. Shredder mechanism 20 includes a drive system (not shown) with at least one motor, such as an electrically powered motor, and a plurality of cutter elements 21. The cutter elements 21 are mounted on a pair of parallel mounting shafts (not shown). The motor operates using electrical power to rotatably drive first and second rotatable shafts of the shredder mechanism 20 and their corresponding cutter elements 21 through a conventional transmission so that the cutter elements 21 shred or destroy materials or articles fed therein, and, subsequently, deposits the shredded materials via the output opening 16. The shredder mechanism 20 may also include a sub-frame for mounting the shafts, motor, and transmission. The drive system may have any number of motors and may include one or more transmissions. Also, the plurality of cutter elements 21 are mounted on the first and second rotatable shafts in any suitable manner. For example, in an embodiment, the cutter elements 21 are rotated (by the motor) in an interleaving relationship for shredding paper sheets and other articles fed therein. In an embodiment, the cutter elements 21 may be provided in a stacked relationship. The operation and construction of such a shredder mechanism 20 is well known and need not be discussed herein in detail. As such, the at least one input opening 14 is configured to receive inserted materials therein to feed such materials through the shredder mechanism 20 and to discharge or eject the shredded materials through output opening 16.

Shredder housing 12 is configured to be supported above the container. For example, shredder housing 12 may be mounted on or seated upon frame 18. In an embodiment, shredder housing 12 comprises a lip or other structural arrangement that corresponds in size and shape with a top edge of the supporting frame 18. The frame 18 may define a waste container 19 receiving space beneath the shredder housing 12. The waste container 19 may be positioned in the frame 18 beneath the shredder housing 12 and receive paper or articles that are shredded by the shredder 10. More specifically, after inserting materials into input opening 14 for shredding by cutter elements 21, the shredded materials or articles are discharged from the output opening 16 on the lower side 15 of the shredder housing 12 into the container 19. The container 19 may be a waste bin, for example. Generally the terms "container," "waste bin," and "bin" are defined as devices for receiving shredded materials discharged from the output opening 16 of the shredder mechanism 20, and such terms are used interchangeably throughout this specification. However, such terms should not be limiting.

In an embodiment, a waste container 19 that is separate and removable from a frame 18 that supports the shredder housing may be used, for example. Removable waste container 19 may receive shredded materials. The waste container receiving space, beneath shredder housing 12 that is defined by frame 18, is configured to allow the waste container 19 to be moved from an operative position beneath the shredder housing 12 for receiving shredder materials discharged from the output opening, to a withdrawn position moved out from beneath the shredder housing 12 (or from beneath the shredder mechanism 20) for emptying of the shredded materials therein. Thus, removable waste container 19 may comprise an opening or recess 17 to facilitate a user's ability to grasp the container 19 (or grasp an area approximate to recess 17), in order to allow the user to easily pull the container 19 in a direction away from the frame 18 to withdraw the container 19 and provide access to shredded materials. Thus, the container 19 may be substantially or entirely removed or withdrawn from the waste container receiving space of the frame 18 to empty shredded materials such as chips or strips (i.e., waste or trash) located in the container 19. Though throughout this description the shredder 10 will be generally described as having a frame 18 and removable waste container 19 therein, the configuration of the container should not be limited to such. For example, in an embodiment, the container 19 may be hingedly mounted to the frame 18, or comprise a step or pedal device to assist in pulling or removing it therefrom, or omitted entirely. Likewise, the frame 18 may be omitted and the shredder housing and container 19 may be configured such that the shredder housing sits directly on the container 19. Generally, container 19 may have any suitable construction or configuration.

Also, in addition or alternatively to frame 18 being a waste bin or comprising a secondary housing to house waste container 19, shredder housing 12 may comprise a detachable shredder mechanism. That is, in an embodiment, the shredder housing 12 may be removed from the frame 18 to ease or assist in emptying the frame 18 (or a waste container 19) of shredded materials.

Also, a control panel may be provided for use with the shredder 10. Generally, the use of a control panel is known in the art. As shown in FIG. 1, a power switch 100 or a plurality of switches may be provided to control operation of the shredder 10. The power switch 100 may be provided on the upper side 11 of the shredder housing 12, for example, or anywhere else on the shredder 10. The power switch 100 may include a manually engageable portion connected to a switch module (not shown). Movement of the manually engageable portion of switch 100 moves the switch module between states. The switch 100 may be a rocker switch, for example. The switch module is communicated to a controller (not shown) which may include a circuit board. Typically, a power supply (not shown) is connected to the controller by a standard power cord with a plug on its end that plugs into a standard AC outlet. The controller is likewise communicated to the motor of the shredder mechanism 20. When the switch 100 is moved to an on position, the controller can send an electrical signal to the drive of the motor so that it rotates the cutting elements 21 of the shredder mechanism 20 in a shredding direction, thus enabling paper sheets to be fed therein. The switch 100 may also be moved to an off position, which causes the controller to stop operation of the motor. Further, the switch 100 may also have an idle or ready position, which communicates with a control panel. The switch module contains appropriate contacts for signaling the position of the switch's manually engageable portion. Generally, the construction and operation of the switch 100 and controller for controlling the motor are well known and any construction for these may be used. Also, the switch need not have distinct positions corresponding to on/off/idle, and these conditions may be states selected in the controller by the operation of the switch.

Referring back to the FIG. 1, the shredder 10 comprises a closure. A "closure" is defined as a device that may be selectively positioned to prevent shredded materials from discharged from the output opening 16. The closure generally provides a mechanical method of closing a door or flap on the lower side of the shredder mechanism 20 in response to a predetermined operational condition of the shredder 10. For example, in an embodiment, the predetermined operational condition of the shredder 10 may include when the shredder housing 12 and container 19 are moved out of an operative position relative to each other. That is, when the container 19 is pulled outwardly from frame 18, the container 19 is moved out of an operative position relative to the shredder housing 12. In an embodiment, the shredder housing 12 may be removed from the frame 18 (e.g., lifted from being atop the container), thus moving itself and the shredder mechanism 20 out of an operative position relative to the frame 18. Additionally, the closure assists in preventing shredded materials from falling into the frame 18 or a surface (e.g., floor) surrounding the shredder 10.

More specifically, the closure may be selectively positioned from a first position to a second position to open or close the output opening 16 of the shredder housing 12 so that shredded materials are permitted or prevented from being discharged from the output opening 16. For example, as noted above, when waste bins or containers 19 are typically emptied, the cutting elements 21 of shredder mechanism 20 may have shredded materials (e.g., particles of waste or trash) caught therein. Thus, when the container 19 is pulled from frame 18, the shredder mechanism 20 may be agitated and the waste particles originally stuck in the cutting elements 21 may become dislodged and fall into housing of frame 18 and/or the area surrounding the shredder 10 (e.g., the floor). Users or consumers using shredders having a pull out waste bin in particular do not expect this type of mess and difficulty when emptying the bin. In particular, users do not want waste particles falling when the bin is not in a position to catch them (i.e., when the container 19 is not under the shredder housing 12). However, the closure, whose embodiments are further described herein, addresses this type of annoying waste particle mess problem by preventing the shredded materials (waste) in or adjacent the shredder mechanism 20 from being discharged during the waste bin emptying process.

Generally, the closure is described throughout the specification as being in an open position or a closed position. An open position is defined as a first position wherein the closure is positioned such that it is adjacent or near the output opening without substantially blocking shredded materials from being discharged therefrom, i.e., allowing shredded materials to be deposited into the container or waste bin. A closed position is defined as a second position wherein the closure is positioned such that it is substantially over or covering the output opening of the shredder housing to prevent shredded materials from being discharged therefrom. Generally, the closure is designed to be in an open position when the shredder 10 is enabled and in an operative position ready for use. For example, when the shredder mechanism 20 and cutter elements 21 are activated such that they are shredding materials placed in the input opening 14, the closure is in an open position.

As noted above, the closure is generally slidably connected to the lower side 15 of the shredder housing 12 and is configured to slide with respect to the output opening 16. The connection or attachment methods may be implemented in any number of ways, some of which are described below. As shown and further described with respect to FIGS. 2, 4, and 6, for example, the closure may be located alongside or adjacent the output opening 16 on the lower side 15 of the shredder housing 12 when in an open position. In an embodiment, the closure may be connected to at least a part of the shredder housing 12. For example, shredder housing 12 may include a guide frame 23 extending from the underside or lower side 15 that partially or substantially surrounds at least the output opening 16. The closure may be connected to or work in cooperation with the guide frame 23. That is, a portion of the closure may be constructed to cooperatively fit with at least a portion of guide frame 23 so that the closure may be guided (e.g., by an actuator) to slide along or with respect to guide frame 23 to be selectively positioned over the output opening 16 to capture shredded materials. Also, in an embodiment, guide frame 23 is designed to extend a length from housing 12 that is capable of holding shredder materials therein without restricting movement of the waste container 19.

As will be further described in the embodiments below of FIGS. 2-10*f*, the actuator of the closure is provided to move the closure to a closed position in response to a predetermined operational condition of the shredder. For example, the actuator may be constructed to move or actuate the closure to a closed position in response to disengagement of the container 19 and the shredder housing 12, or when the waste container is moved to a withdrawn position (i.e., moved substantially from beneath the shredder mechanism 20, or, alternatively, from the waste container receiving space of frame 18).

Accordingly, the closure provides a mechanical method of closing and/or sliding a door or flap on the lower side of the shredder mechanism 20 in response to a predetermined operational condition. Specifically, each of the embodiments described below generally discuss the container 19 being pulled away from the frame 18/shredder housing 12 as the devices being moved out of an operative position relative to each other. However, as will be noted, the actuation of the actuator for moving the closure to a second or closed position should not be limited to removal of the container 19. Nonetheless, in some embodiments, the closure assists in substantially reducing and/or substantially eliminating waste or trash from being distributed in or around the shredder 10 when the container 19 is pulled relative to the shredder housing 12. Further advantages of the closure will become more evident and will be described in the embodiments below.

Figure 2:
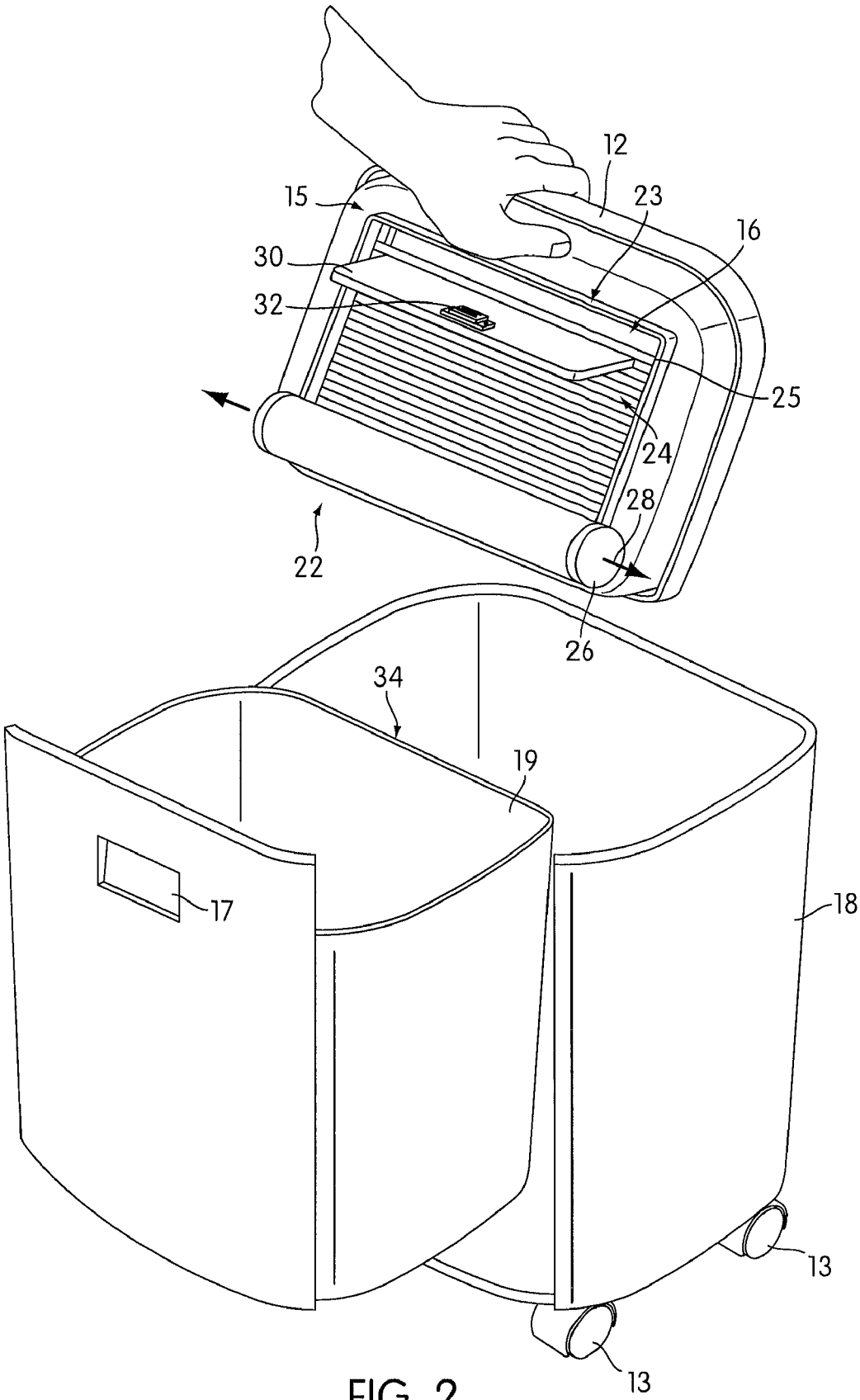
FIG. 2 is a detailed perspective view of a lower side of a shredder housing of the shredder apparatus of FIG. 1 with a rolling closure in accordance with an embodiment of the present invention.

The closure of FIG. 2 is a rolling closure 22 in accordance with an embodiment of the present invention. Rolling closure 22 comprises a door 24 and drum 26. Guide frame 23 substantially surrounds the perimeter of the output opening 16 and is designed to guide at least ends 25 of the door 24 between a closed (i.e., a second position wherein the door 24 is extended from drum 26) and an open (i.e., a first position wherein the door 24 is retracted or withdrawn into drum 26) position. Drum 26 is provided at a first end along or adjacent guide frame 23. Drum 26 is constructed to assist in storing door 24 therein. Specifically, door 24 is assembled such that it may be selectively rolled about axis 28 to slide along guide frame 23 and be retracted and stored within the drum 26 when the shredder 10 is in use. In an embodiment, door 24 comprises a plurality of interconnected slats which allow door 24 to be easily rotated about axis 28. Alternatively, the door 24 may be a web of flexible material, such as plastic or textile.

In order to selectively position the rolling closure 22 to cover at least part of the output opening 16, the door 24 comprises an actuator. "Actuator" is defined as a device that actuates movement of a closure between a plurality of positions. The actuator comprises an engagement part for connecting to at least a part of the closure 22. The engagement part may provide a method for allowing removable engagement with the waste container 19, for example. The engagement part of FIG. 2 comprises an extension flap 30 with a magnetic plate or magnet 32 located thereon. The extension flap 30 is provided at the opposite end of the drum wheel 26, or a second end, and extends downwardly from the output opening 16 toward the waste container 19. The magnet 32 assists in allowing or enabling the flap 30 to be removably engaged by the container 19. More specifically, the magnet 32 is designed to be removably engaged to a magnetizable element 34 (e.g., a magnetically attracted material) provided on at least a portion of the back of the container 19. In an embodiment, a pair of magnets may be used on the engagement part (flap 30) and the container 19. However, it should be noted that any number of materials or methods may be used to removably connect the closure 22 to the waste container 19. Additionally, any number of magnetic or other removable connections may be provided.

Figure 3A:
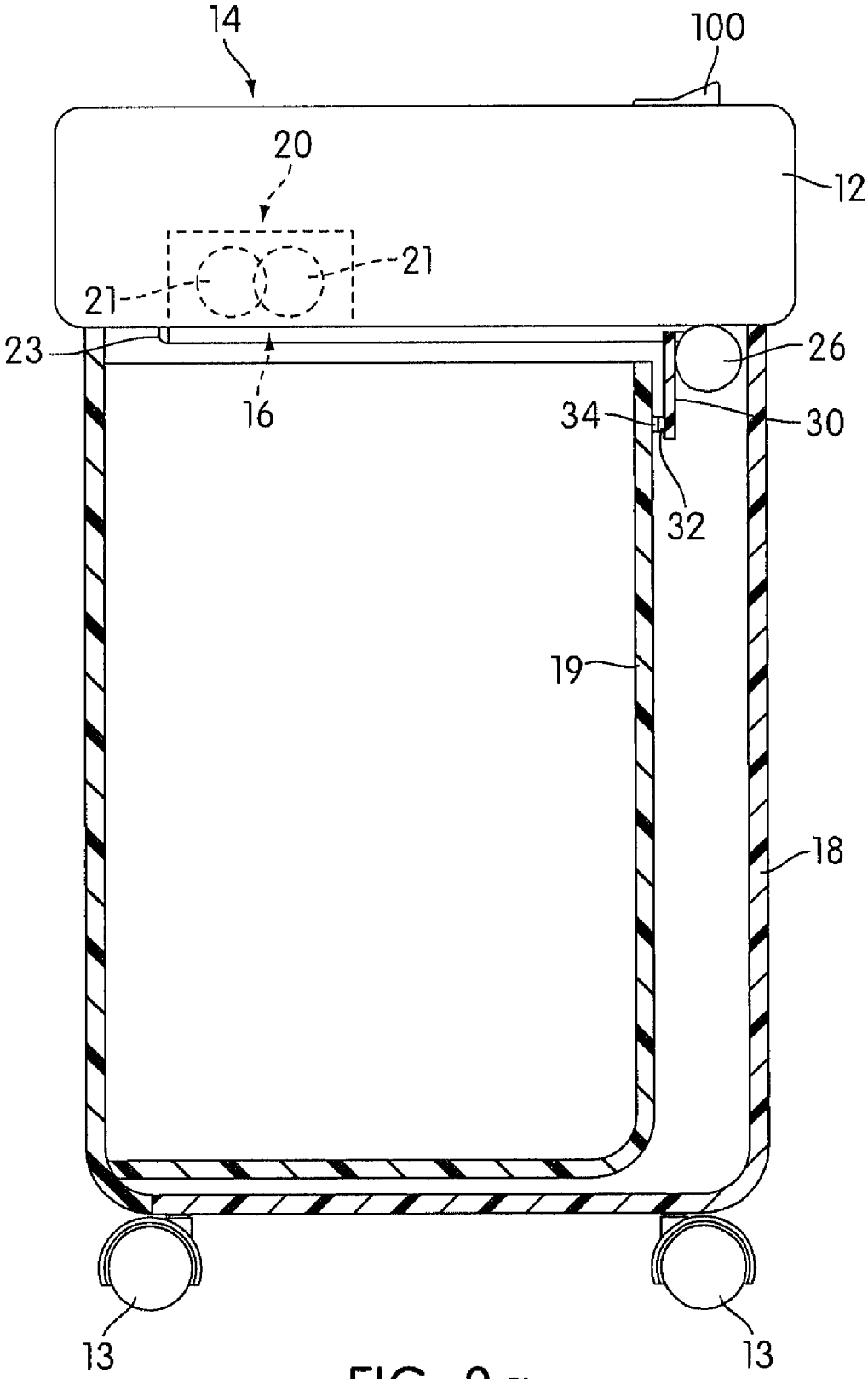
FIG. 3*a*-3*c* illustrate side views showing the method of use of the rolling closure of FIG. 2 in accordance with an embodiment of the present invention.
Figure 3B:
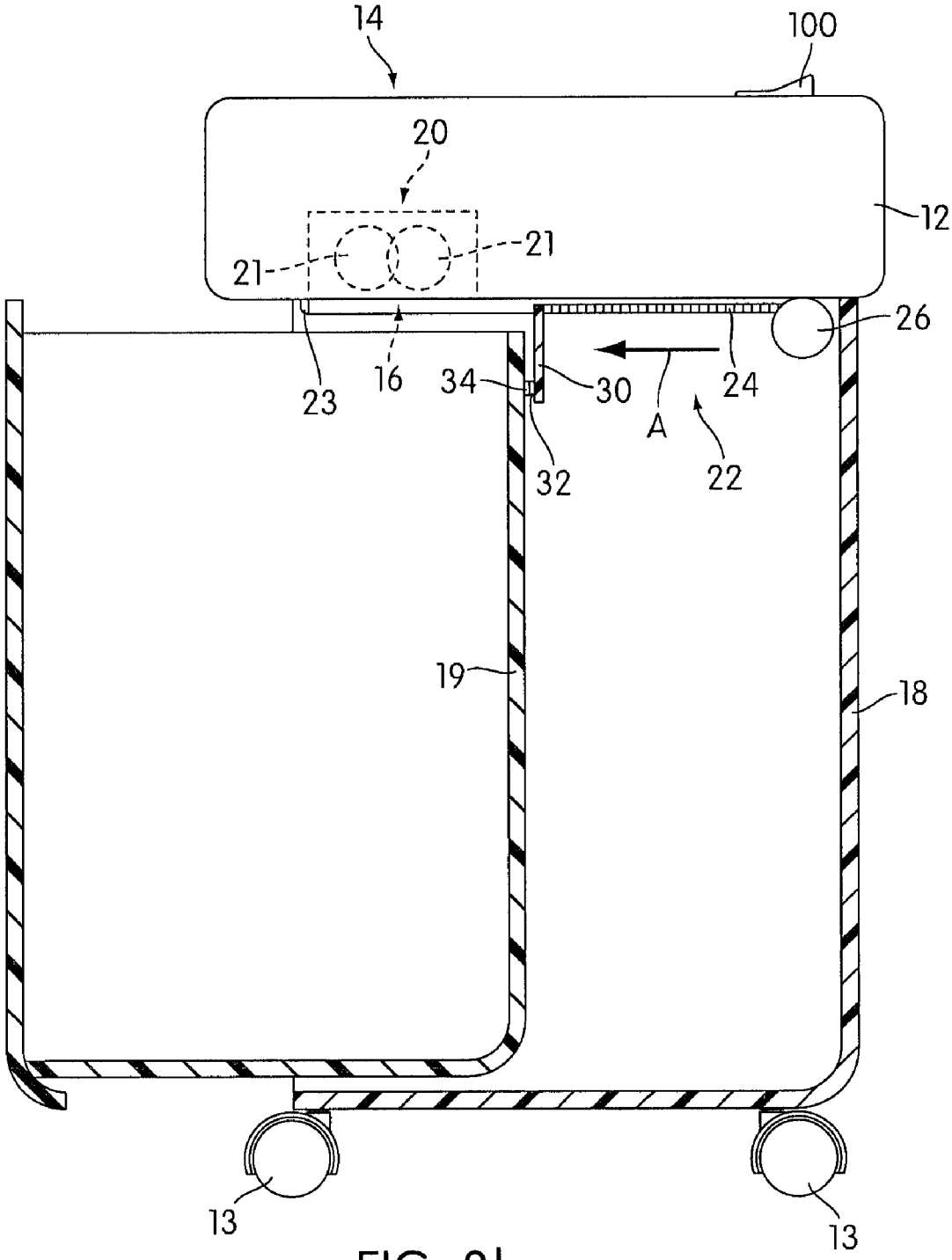
Figure 3C:
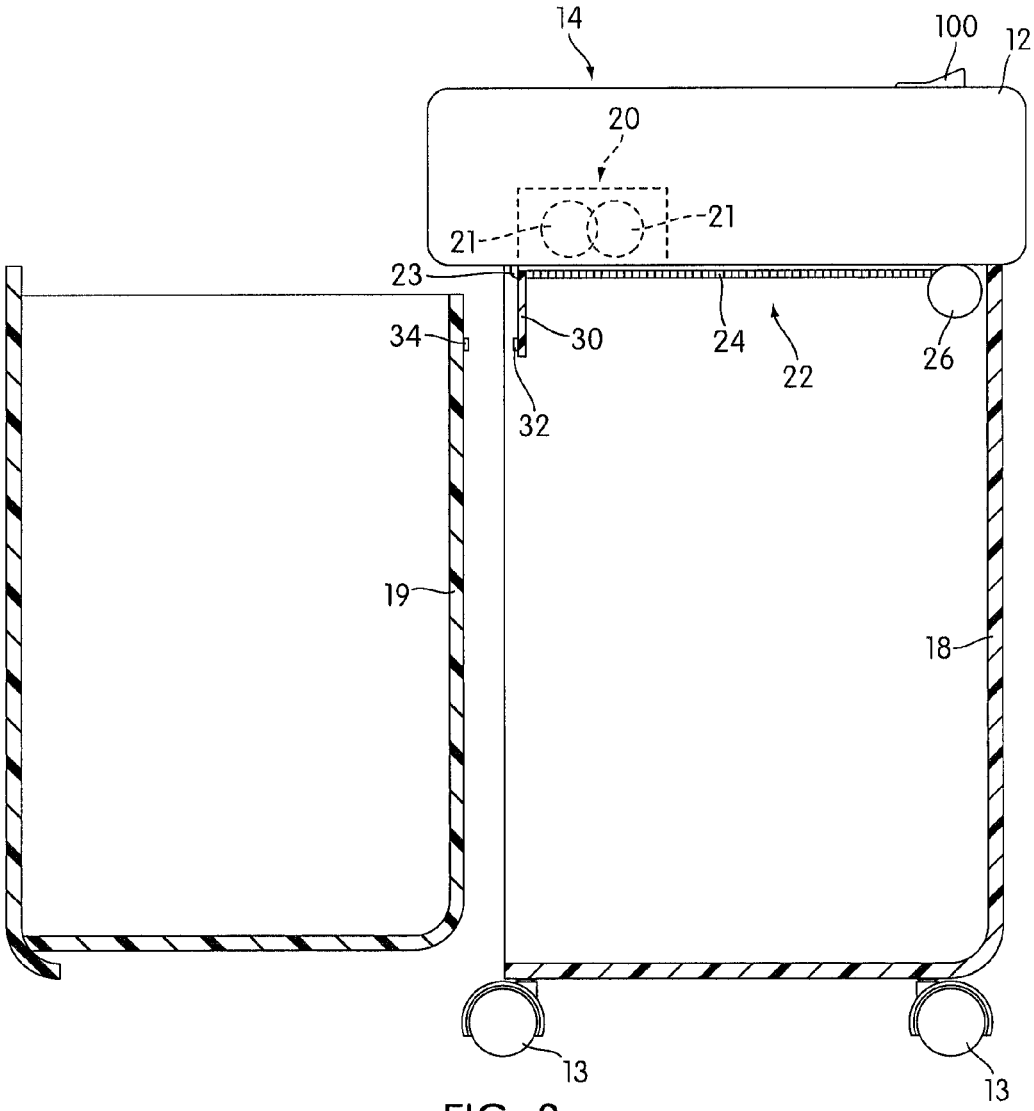

FIGS. 3*a*-3*c* illustrate side views showing the method of use of the rolling closure 22. As shown in FIG. 3*a*, when the container 19 is fully inserted into the frame 18, i.e., in the operative position, the closure 22 is in an open position such that the output opening 16 is unobstructed so that articles or materials placed in the input opening 14 (or 14*a*) are shredded via the cutter elements 21 of the shredder mechanism 20 and deposited into the container 19. That is, the door 24 is substantially rolled into and stored in drum 26. The magnetizable element 34 on container 19 and magnet 32 on extension flap 30 are also connected to each other.

In order to dispose of shredded materials (i.e., waste or trash) from the container 19 of shredder 10, the user must access its contents and pull the container 19 from the frame 18. When a user starts to remove or pull the container 19 (e.g., via recess 17) in a direction away from the frame 18, i.e., to a withdrawn position, as shown by arrow A in FIG. 3*b*, the magnetic connection between the magnet 32 on the flap 30 of the closure 22 and magnetizable element 34 on the backside of the container 19 allows the user to pull on the container 19 and thus actuate the actuator. As the user pulls in the direction as indicated by arrow A, the user also moves the extension flap 30 which moves the closure 22. That is, the extension flap 30 is moved to move the closure in the direction of the pulling force. Thus, the door 24 is pulled and retracted from the drum wheel 26 and guided at its ends 25 to slide along guide frame 23 to a second, closed position. When the container 19 is substantially (or completely) removed from the frame 18, the door 24 of the closure 22 covers at least part of the output opening 16, as shown in FIG. 3*c*.

Also, as shown in FIG. 3*c*, the guide frame 23 may act as a stop for the door 24 of the closure 22. Thus, when the flap 30 comes into contact with at least part of the guide frame 23 at the second end, the closure 22 is fully extended. The user may supply continued force on the container 19 to break the magnetic attraction between magnet 32 and magnetizable element 34 to thus remove the container 19 entirely from frame 18.

After emptying the contents of container 19, the user moves the container 19 into the operative position. When a user inserts the container 19 into the frame 18, the magnet 32 of the flap 30 and magnetizable element 34 on the portion of the back of the container 19 will be magnetically attracted to each other. Thus, they will reconnect, and, as the user pushes the bin into the frame 18 (i.e., in the opposite direction of arrow A in FIG. 3*b*), the flap 30 is moved to move the closure 22 rearwardly to the first, open position at the first end of the guide frame 23. The door 24 is actuated to retract into the drum roll 26 thereby uncovering or opening the outlet opening 16 and allowing shredded materials to be deposited to the container 19.

In some embodiments, guide frame 23 may extend from shredder housing 12 at a predetermined distance from the lower side 15 (e.g., about 2 to about 6 inches below the shredder housing 12). Guide frame 23 may comprise dimensions that position the closure at a distance from the shredder housing 12 or shredder mechanism 20 so as to allow for accumulation of shredded articles over a short interval of time. For example, should a user need to continue the shredding operation but also empty container 19, the user may remove container 19 from the frame 18, thus moving the closure, while the cutter elements 21 of the shredder mechanism 20 continue to rotate via the motor. Any shredded articles would then accumulate on the door or flap or in an area below the shredder mechanism 20 near the guide wall 23 as they fall from the shredder mechanism 20. When the user inserts the container 19 back into frame 18, the shredded articles would then be deposited into the container 19 as the closure is opened.

In some embodiments, the shredder 10 may include one or more sensors located between the closure and the shredder mechanism 20 that are configured to detect the level of shreds accumulated on the closure or in the area. In some embodiments, if the shredder mechanism 20 is rotating when the container 19 is pulled out from the frame 18, the shredder mechanism 20 may rotate for a predetermined amount of time before a controller/motor ceases its rotation. For example, if the user removes the container and the closure is determined to be in a closed position for more than about 60 seconds to about 120 seconds, the shredder mechanism 20 may stop rotating.

Figure 4:
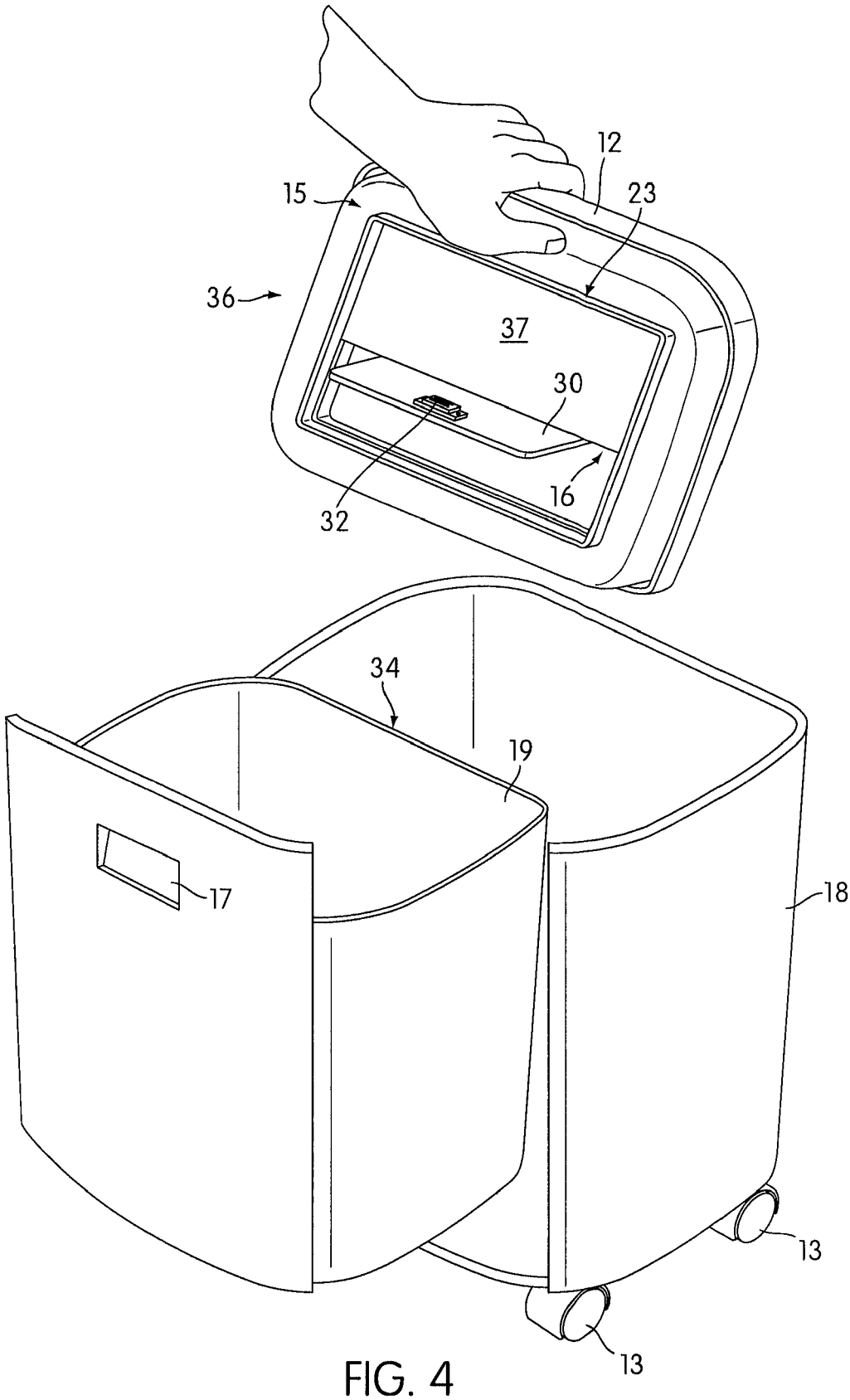
FIG. 4 is a detailed perspective view of a lower side of a shredder housing with a sliding closure in accordance with an embodiment of the present invention.
Figure 5A:
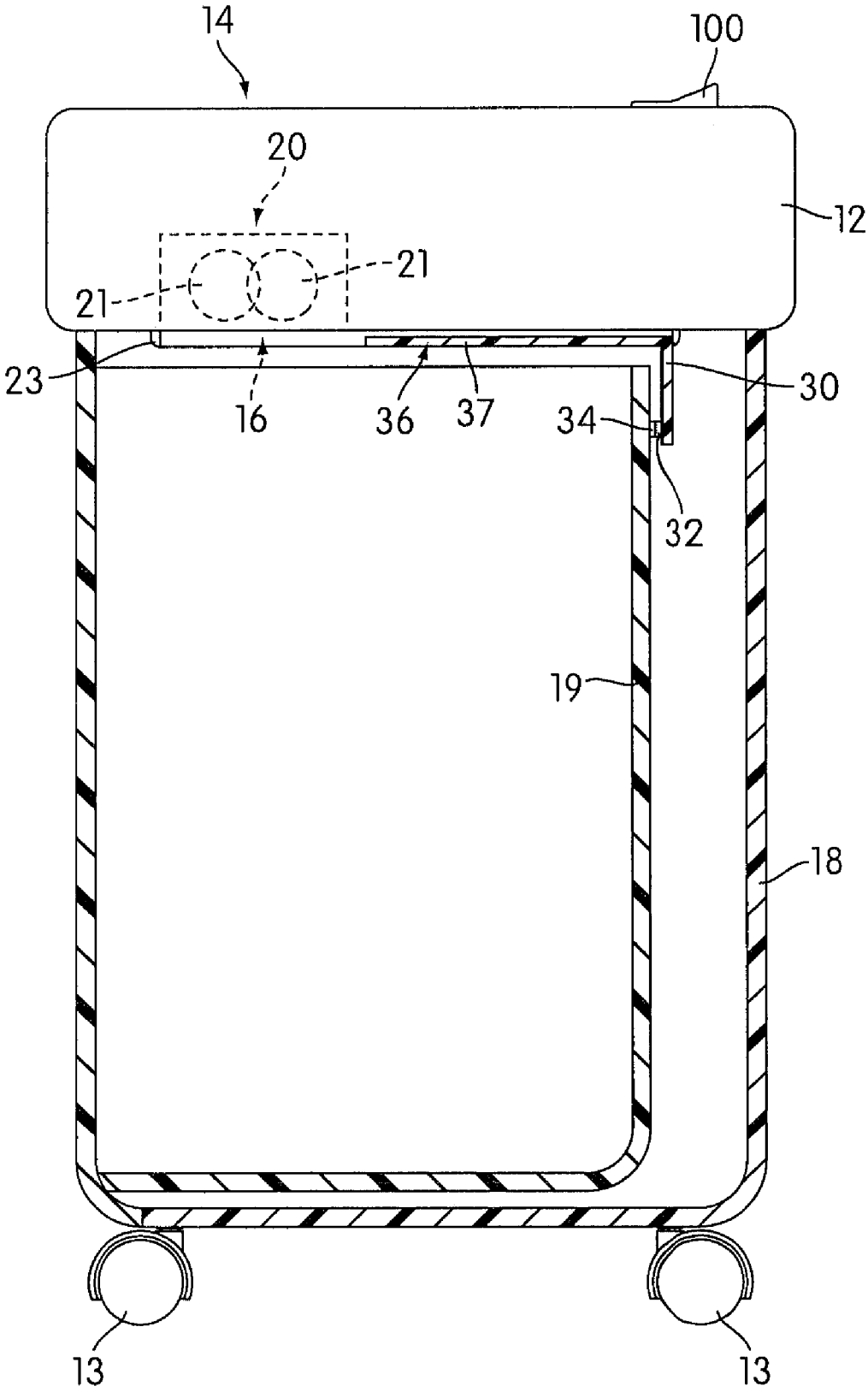
FIGS. 5*a*-5*c* illustrate side views showing the method of use of the sliding closure of FIG. 4 in accordance with an embodiment of the present invention.
Figure 5B:
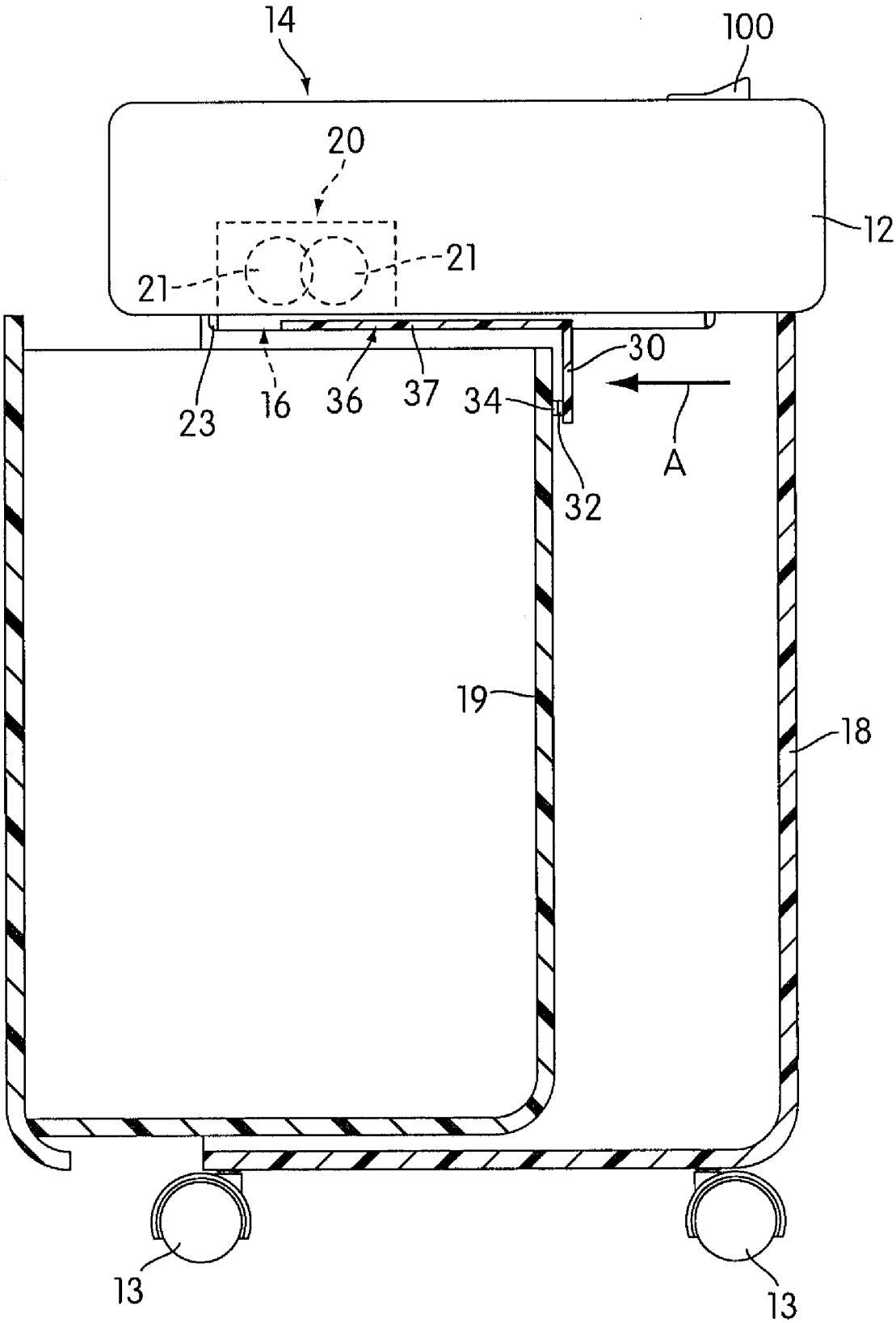
Figure 5C:
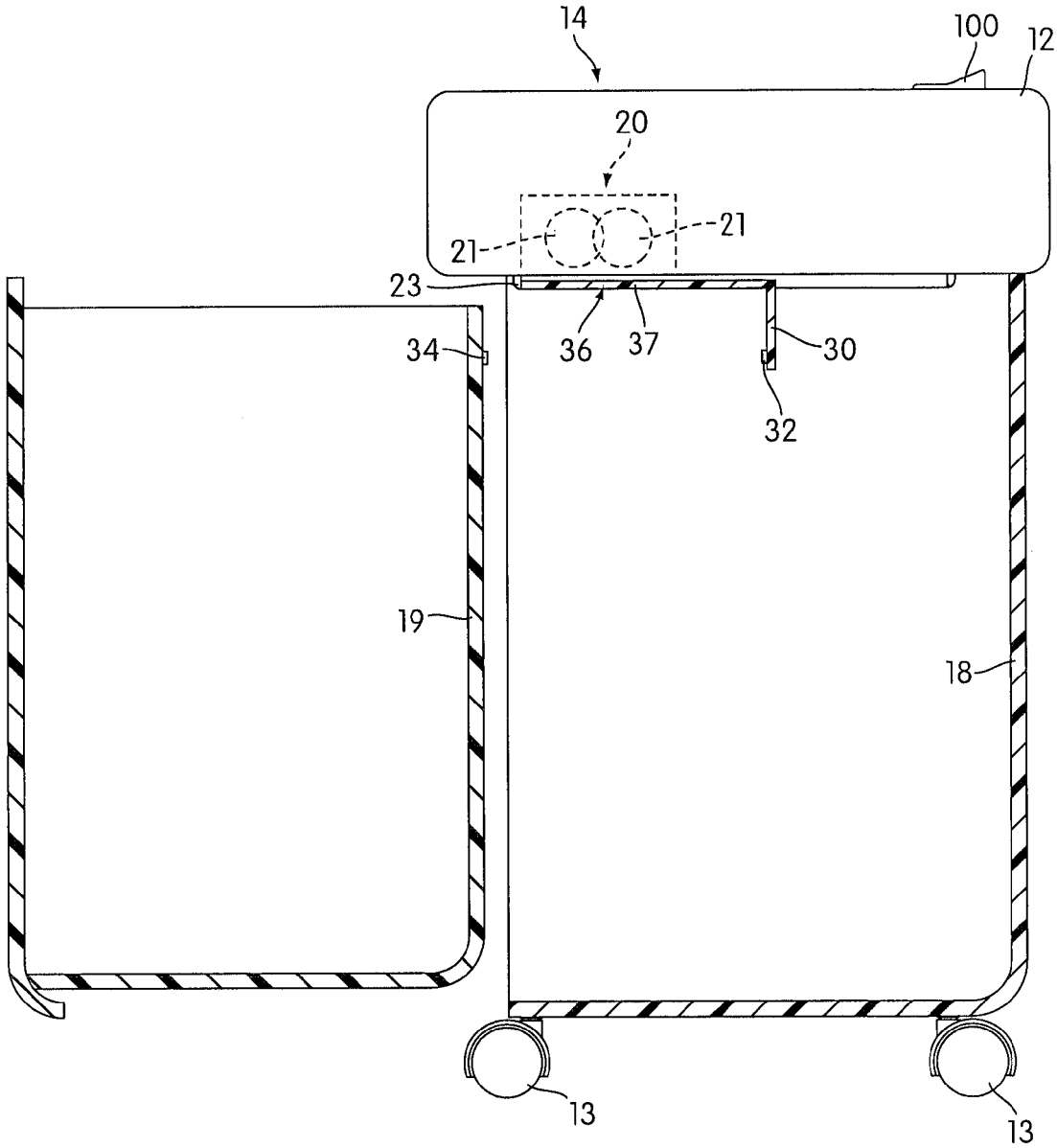

FIG. 4 is a detailed perspective view of a lower side 15 of a shredder housing 12 of a shredder 10 such as shown in FIG. 1 comprising a sliding closure 36 in accordance with an embodiment of the present invention. Like rolling closure 22 as shown in FIG. 2, sliding closure 36 is designed to be located adjacent the output opening 16 and selectively positioned to capture shredded materials discharged from the output opening 16, particularly when the container 19 is substantially removed for emptying.

Sliding closure 36 comprises a flap 37 and an actuator in the form of an extension flap 30, similar to the flap 30 described above in FIG. 2. Flap 37 comprises a size, shape and/or dimensions to substantially cover at least a part of the output opening 16. The flap 37 is actuated to substantially slide from a first side to a second side of the perimeter-surrounding guide frame 23 when a user pulls the container 19 from the frame 18. For example, as shown in the side views of FIGS. 5*a*-5*c*, the flap 37 of the sliding closure 36 is in a first, open position at a first end of the guide frame 23 when the bin is fully inserted. The output opening 16, therefore, is unobstructed and shredded materials are deposited into container 19. As the bin is pulled by a user to a withdrawn position in the direction of arrow A, the flap 37 slides along the guide frame 23 toward a closed, second position at a second end of the guide frame 23. The user may then disconnect the magnets 32, 34 and empty the container 19.

After emptying the contents of container 19, the user inserts the container 19 into the frame 18 to move the container 19 into an operative position. The magnetic connection of magnet 32 and magnetizable element 34 is reconnected as the container 19 is pushed into frame 18 in a similar manner as described above, thus opening the output opening 16 after the container 19 is fully inserted therein.

Figure 6:
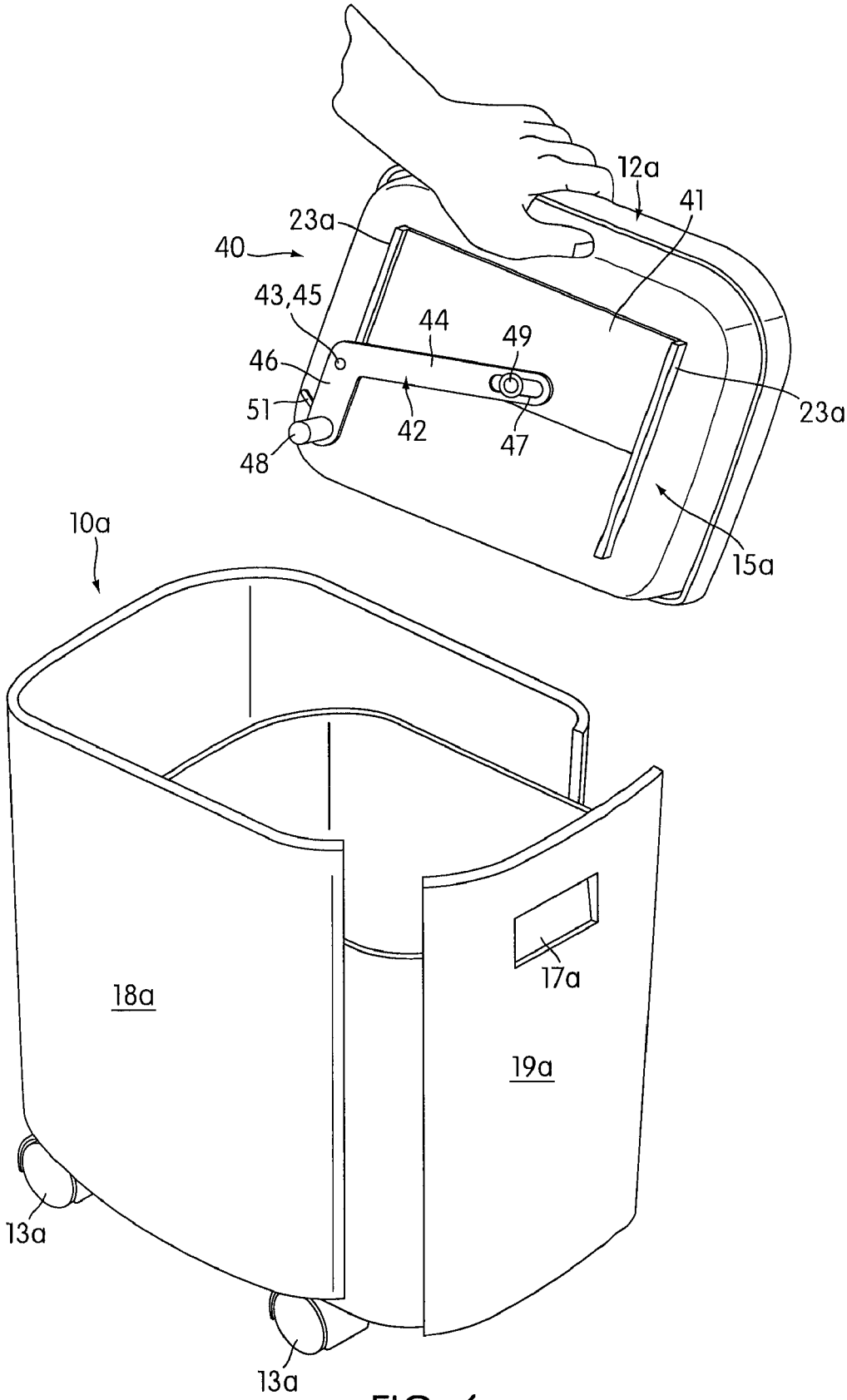
FIG. 6 is a detailed perspective view of a lower side of a shredder housing with a spring-actuated closure in accordance with an embodiment of the present invention.

FIG. 6 is a detailed perspective view of a lower side 15*a* of a shredder housing 12*a* with a spring-actuated closure 40 in accordance with an embodiment of the present invention. Spring-actuated closure 40 may be used, for example, with a shredder housing 12*a* comprising a sideways-oriented shredder mechanism (i.e., with the input opening extending from front to back, instead of laterally), as generally shown in FIG. 6, for a shredder 10*a*. However, it is envisioned that spring-actuated closure 40 may also be used with shredder 10 with shredder housing 12 having a shredder mechanism 20 oriented in a manner as shown in FIG. 2, for example. The application of spring-actuated closure 40 should not be limited to sideways-oriented shredder mechanisms.

Figure 7A:
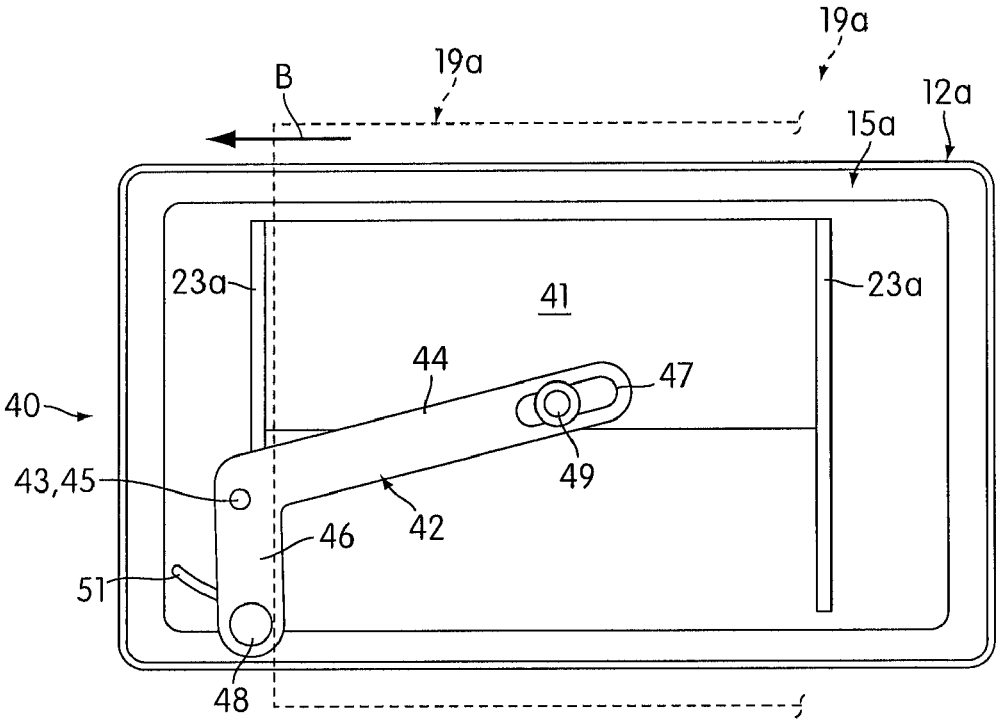
FIGS. 7*a*-7*c* illustrate bottom views showing the method of use of the closure of FIG. 6 in accordance with an embodiment of the present invention.

Spring-actuated closure 40 is constructed such that the actuator comprises a resilient mechanism 45, such as a spring, to assist in selectively positioning the closure 40 at least from the open position to the closed position and/or holding the device 40 in a closed position. Spring-actuated closure 40 comprises a sliding flap 41 and an actuation arm 42. Actuation arm 42 is actuated to move sliding flap 41 from an open position to a closed position, for example. Actuation arm 42 comprises a first elongated part 44 and a second part 46. As shown, first and second parts 44 and 46 generally comprises a "L" shape and are arranged to be pivotable about a pivot point 43. A resilient mechanism 45 is associated with arm 42. For example, a resilient or elastic mechanism such as a spring may be provided. Generally, resilient mechanism 45 is provided at pivot point 43 and is assembled or constructed such that the torsion of the resilient mechanism may be used to assist in directing the flap 41 to a closed position. For example, in an embodiment, when the closure 40 is moved to an open position beneath the shredder housing 12 (e.g., as shown in FIG. 7*c*), the resilient mechanism 45 may be forced into torsion. Thus, when the container 19 is removed from frame 18, the resilient mechanism 45 is thus released and the torsion is used to aid in forcing the flap 41 towards the closed position (e.g., as shown in FIG. 7*a*). Alternatively, it is envisioned that the spring-actuated closure 40 may be constructed such that a resilient mechanism 45 may be used to assist in holding the flap in an open position.

Referring back to FIG. 6, first elongated part 44 of arm 42 comprises an elongated opening or hole 47 for connection device 49. Connection device 49 is attached to a portion of flap 41 and assists in directing flap 41 to an open position. Connection device 49 is designed to move or slide within elongated opening 47 of first part 44. Arm 42 also comprises an engagement part in the form of an extended actuating handle 48. The actuating handle 48 is designed such that it extends in a downward direction into the frame 18*a* so that, as container 19*a* is pushed into the container, at least a portion of the back of the container 19*a* engages the actuating handle 48 of arm 42 and activates the arm 42 so that it directs the flap 41 into an open position.

Shredder housing 12*a* comprises a guide frame 23*a* on opposing sides of the output opening on the lower side 15*a*. Guide frame 23*a* comprises first and second elongated tracks located on opposite sides of the output opening, for example. In an embodiment, guide frame 23*a* may substantially surround the perimeter of the output opening such as shown by guide frame 23 in FIG. 4. The first and second elongated tracks of guide frame 23*a* may comprise a length that is substantially twice the size of flap 41, for example.

Guide opening 51 is also provided in the lower side 15*a* of housing 12*a*, adjacent the guide frame 23*a* and below the second part 46 of the actuating arm 42. Guide opening 51 assists in guiding arm 42. Guide opening 51 is a slot substantially of an arc shape. In an embodiment, an opposite side of actuating handle 48 comprises an extending pin (not shown) which is at least partially inserted into guide opening 51. When activated, the extending pin of the arm 42 is guided within the guide opening 51. Guide opening 51 may also act as a limiting device. For example, the shape, length, or dimensions of guide opening 51 may assist in preventing the arm 42 from being overextended, thus also preventing the resilient mechanism 45 from being strained. Thus, a user may be limited from pushing flap 41 towards a first or second end by guide frame 23*a*, or, alternatively, by the guide opening 51.

Figure 7B:
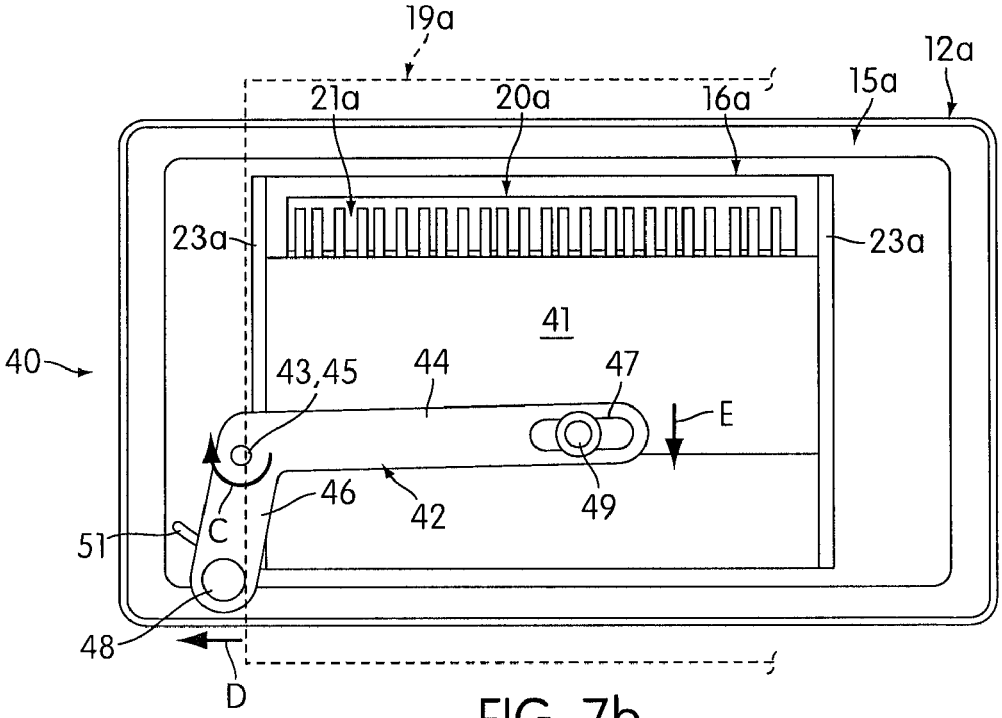
Figure 7C:
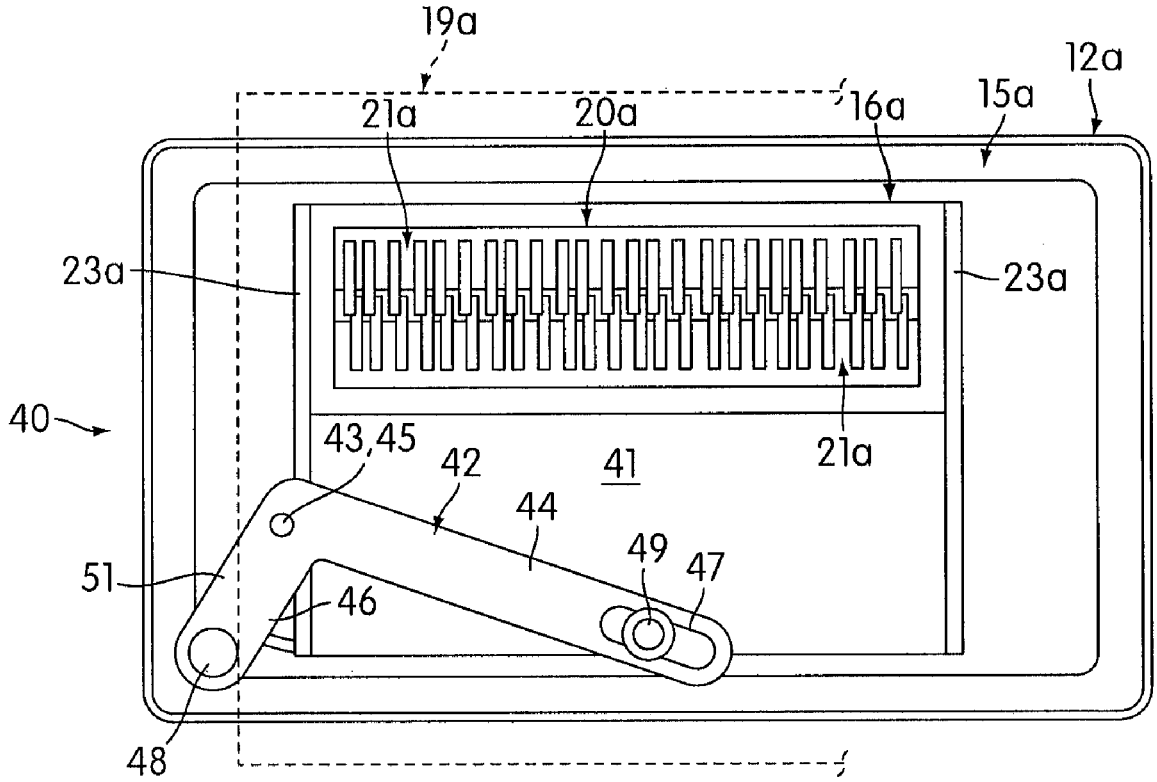

FIGS. 7*a*-7*c* illustrate bottom views showing the method of opening and closing the closure 40 of FIG. 6. The actuation of spring-actuated closure 40 is described herein as the container 19*a* is inserted into the frame 18*a* into an operative condition, rather than the container 19*a* being withdrawn. However, it is assumed that after reading such description that one skilled in the art will understand the positioning of spring-actuated closure 40 as the container 19*a* is removed.

FIG. 7*a* illustrates flap 41 of closure 40 in a second, closed position. The resilient mechanism 45 or spring associated with pivot point 43 assists in pushing arm 42 in a second, closed direction toward a second end of the tracks of guide frame 23*a*. As container 19*a* is inserted into frame 18*a*, as represented by arrow B, as least a portion of the back of container 19*a* engages the extended actuating handle 48 on the second part 46 of arm 42. Thus, as shown in FIG. 7*b*, as the user pushes the container 19*a* therein, the arm 42 is actuated by the container 19*a* to move and direct or move the flap 41 to at least a partially open position in the direction of a first end of the guide frame 23*a*. More specifically, as at least a portion of the back of the container 19*a* comes into contact with the handle 48 of arm 42, the arm 42 pivots about pivot point 43 and is guided along guide opening 51. The arm 42 is substantially rotated in a clockwise direction about pivot point 43 as indicated by arrow C. The second part 46 of the arm 42 is substantially moves in a direction as indicated by arrow D, while the first part 44 is substantially moved in a direction as indicated by arrow E.

When container 19*a* is fully inserted into frame 18*a*, the back of the container 19*a* remains in contact with actuating handle 48 and thus assists in holding arm 42 and flap 41 in a substantially open position as illustrated in FIG. 7*c*. As shown, the flap 41 is directed via guide frame 23*a* to an area alongside or adjacent output opening 16*a*. Thus, the output opening 16*a* is unobstructed and shredder mechanism 20*a* and cutter elements 21*a* are exposed so that shredded materials are free to be deposited into container 19*a*. When container 19*a* is removed from the frame 18*a* to the withdrawn position, the resilient mechanism 45 of the spring-actuated closure 40 assists in using its torsion to rotate arm 42 about pivot point 43 toward the second, closed position, covering the output opening 16*a*.

Figure 8A:
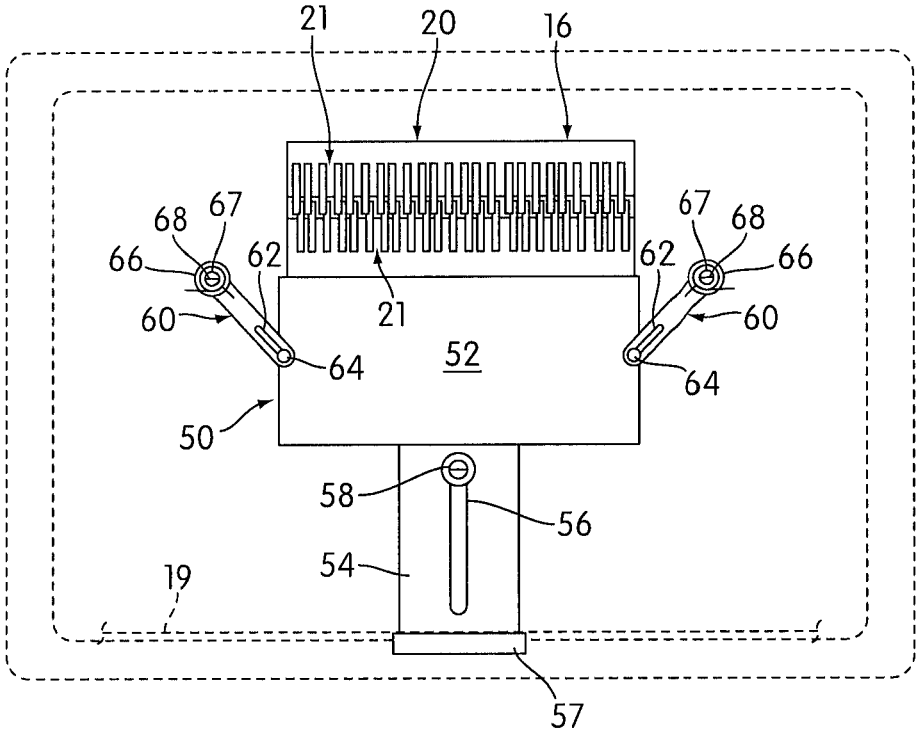
FIGS. 8*a*-8*c* illustrate bottom views showing the method of use of a sliding closure with pivot arms of alternate configuration in accordance with an embodiment of the present invention.
Figure 8B:
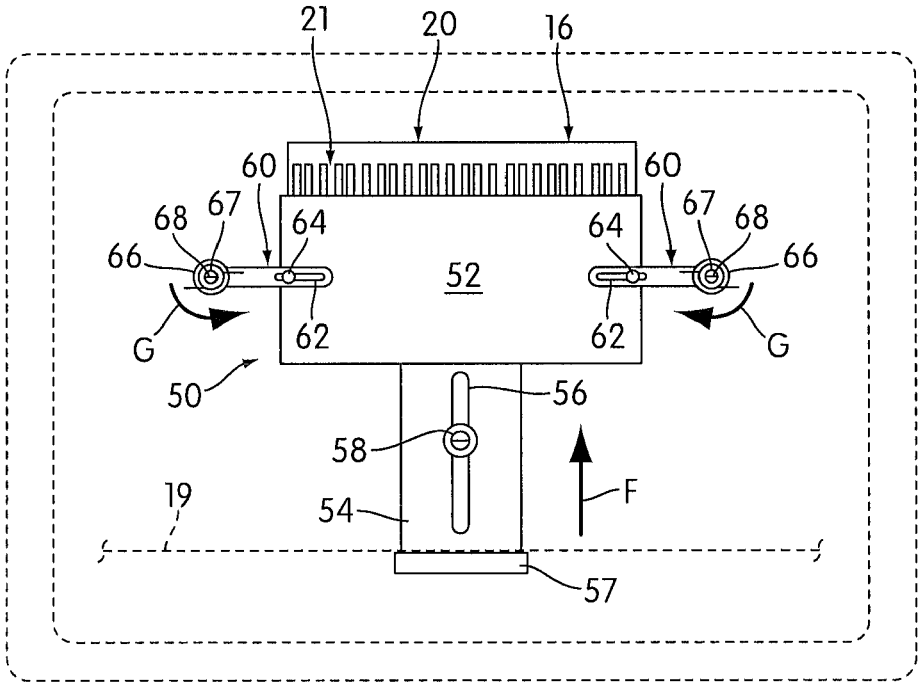
Figure 8C:
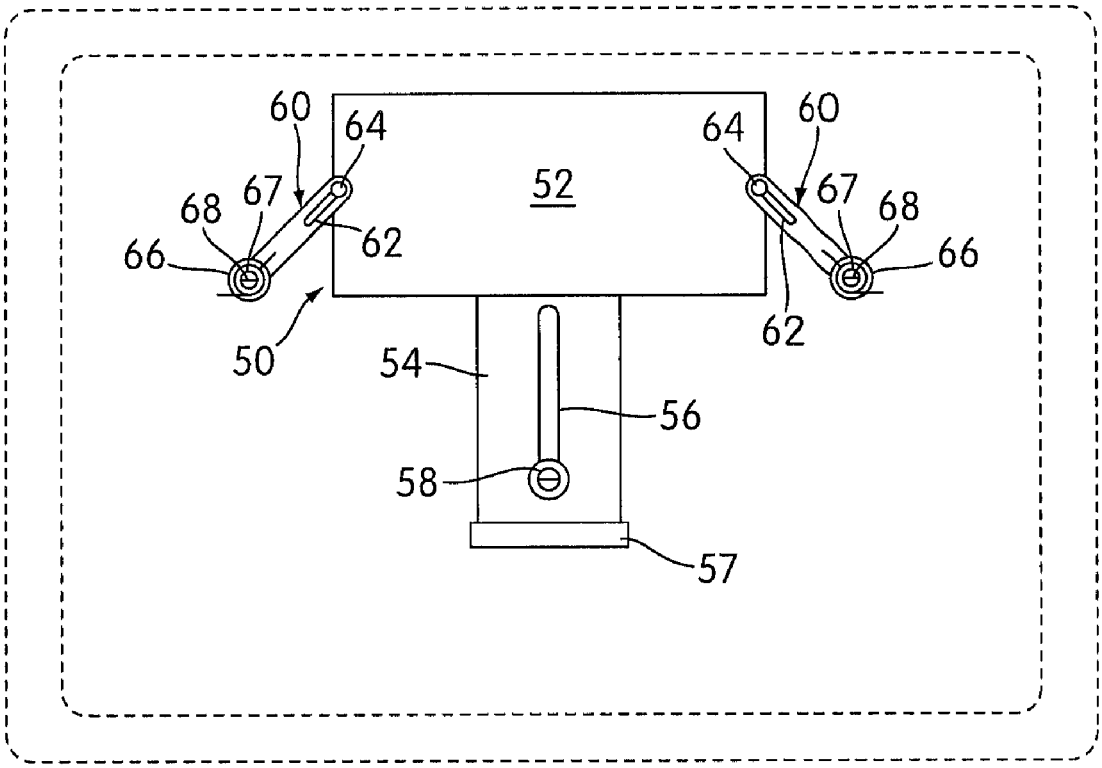

FIGS. 8*a*-8*c* illustrate bottom views of a sliding closure 50 with pivot arms 60 and its method of use in accordance with an embodiment of the present invention. Sliding closure 50 comprises a slide flap 52 for covering at least part of the output opening 16 of shredder housing 12. In an embodiment, slide flap 52 may comprise a size, shape, and/or dimensions substantial enough to cover output opening 16. Slide flap 52 has an extension portion 54 and an actuating end 57 that are used to assist in transferring or moving the flap 52 from a second, closed position to a first, open position. Extension portion 54 has an elongated opening 56 which allows insertion of a fastener and washer combination 58 therein. The fastener and washer combination 58 are attached in a permanent location on the lower side 15 of the shredder housing 12. The elongated opening 56 allows the closure 50 to slide with respect to the fastener and washer combination 58. The length of the elongated opening 56 may be designed to limit the movement of the closure 50 in either direction. Actuating end 57 extends downwardly into the container in a substantially similar manner as described above with respect to extending actuating handle 48. Actuating end 57 is constructed to come into contact with at least a portion of a backside of container 19 so as to actuate movement of sliding closure 50.

Figure 10A:
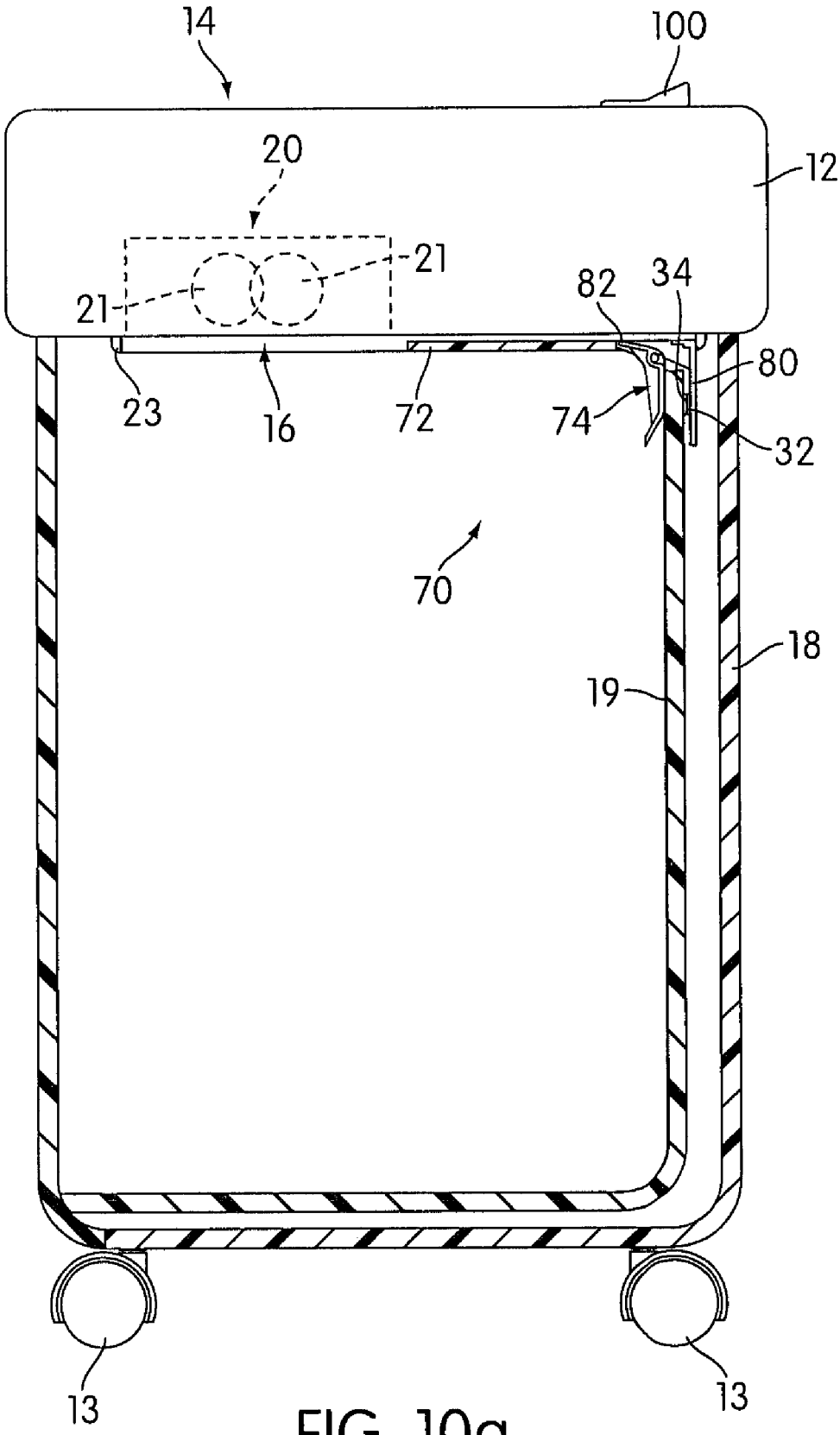
FIGS. 10*a*-10*f* illustrate side views showing the method of use of the closure of FIG. 9 in accordance with an embodiment of the present invention.

Slide flap 52 also comprises an actuator comprising pivot arms 60 on its sides. As shown in FIG. 10*a*, pivot arms 60 are connected to the lower side 15 of shredder housing 12 at pivot points 68. The pivot points 68 are provided adjacent opposite ends of the output opening 16. The pivot arms 60 are connected at pivot points 68 using fasteners and may comprise resilient mechanisms, such as springs 66 and plastic washers 67. The pivot arms 60 are designed to rotate or pivot about pivot points 68. Springs 66 are provided at pivot points 68 to assist in providing spring-actuation of the closure 50 toward a specific position. For example, like spring 45 described with reference to FIG. 6, springs 66, in an embodiment, are assembled or constructed such that the springs 66 are in torsion when the container 19 is fully inserted into the frame 18. Thus, when the container 19 is removed, the closure 50 is aided by the torsion in springs 66 to force the flap 52 towards the closed position. Alternatively, it is envisioned that the springs 66 may be used to assist in holding the flap in an open position.

The opposite ends of pivot arms 60 are connected via fasteners such as assembly screws 64 to each end of the slide flap 52. The fasteners 64 or screws are inserted through the openings 62 provided on the pivot arms 60. The openings 62 allow the pivot arms 60 to slide with respect to the fasteners 64 as the flap 52 moves from an open to a closed position (or vice versa).

FIG. 8*a* shows the sliding closure 50 in a first, open position. For simplicity purposes, container 19 is represented by a single line; however, it should be understood that the container 19 is of a shape to be inserted fully into the frame 18 and to hold shredded materials therein. At least a portion of the backside of the container 19 is engaged with and in direct contact with the actuating end 57 of the closure 50. In this position, springs 66 are torsioned about pivot points 68. As the container 19 is removed from the container to a withdrawn position in a direction as represented by arrow F in FIG. 8*b*, the torsion of the springs 66 assists in rotating pivot arms 60 about pivot points 68 in a clockwise direction, as represented by arrows G. Also, extension portion 54 moves with respect to fastener and washer combination 58 via elongated opening 56, and fasteners 54 move within openings 62 of pivot points 60 (e.g., accommodating the adjustment in their length as they are rotated about the pivot points 68). The extension portion 54 moves the flap 52. The slide flap 52 begins to cover the output opening 16 and the shredder mechanism 20 and cutter elements 21. Once the container 19 is fully removed from the secondary housing or frame 18, the pivot arms 60 are rotated via torsion springs 66 to direct the slide flap 52 to cover the output opening 16, as shown in FIG. 8*c*.

When the user pushes the container 19 into the frame 18, into an operative position, at least a portion of the backside of the container 19 engages the actuating end 57 of extension portion to thus actuate the flap 52 to an open position and pivots the arms 60 about pivot points 58. When container 19 is fully inserted into frame 18, the back of the container 19 remains engaged with the actuating end 57 and thus assists in holding flap 52 via extension portion 54 in a substantially open position as illustrated in FIG. 8*a*.

Also, it should be noted that, although a guide frame 23 is not specifically shown or described to be used with the sliding closure 50 in FIGS. 8*a*-8*c*, a guide frame 23 of any type (e.g., surrounding a perimeter, extending as tracks along opposing sides, or as a single track on the lower side 15 of the housing 12) may be used herewith.

Figure 9:
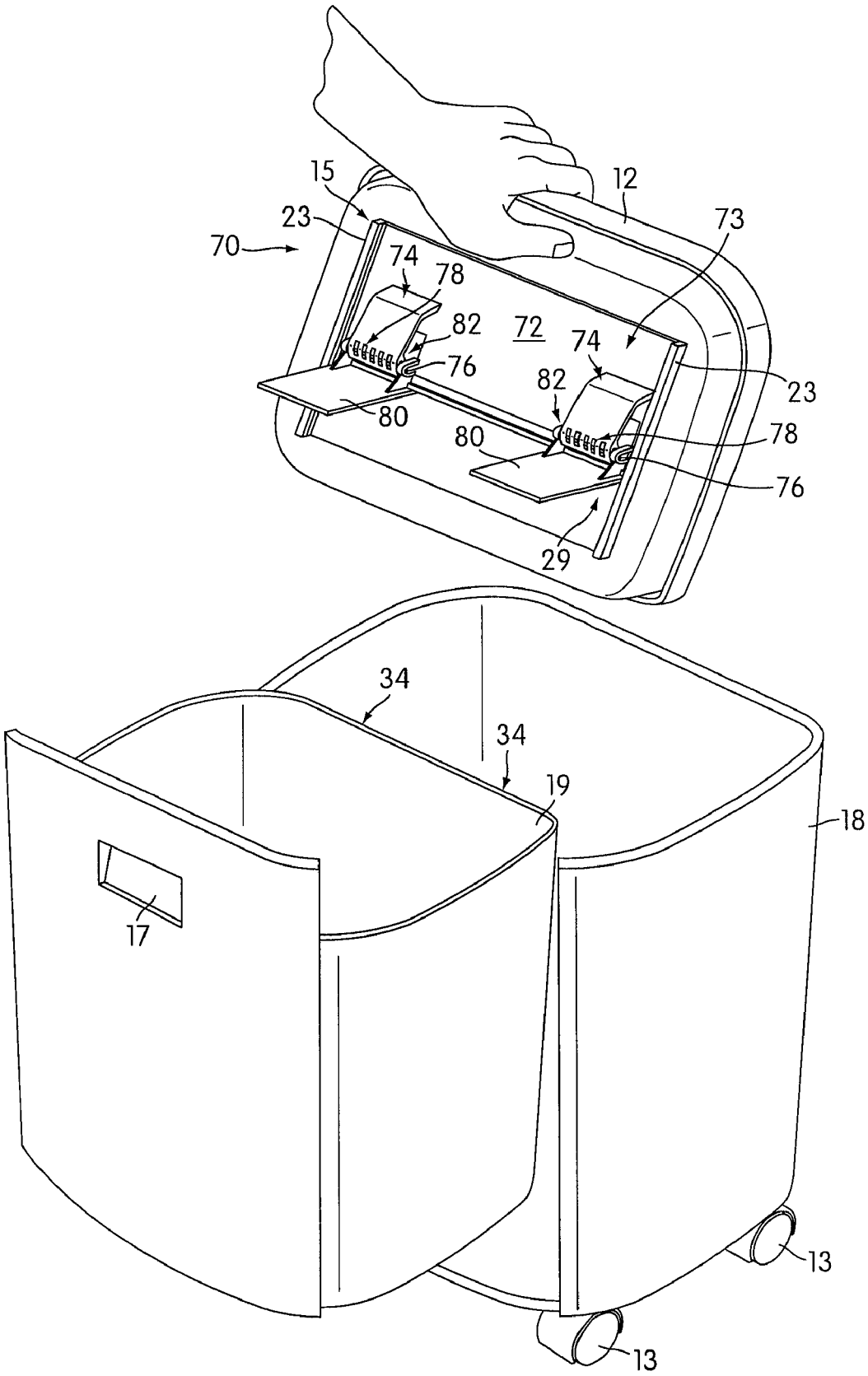
FIG. 9 is a detailed perspective view of a lower side of a shredder housing with a sliding closure of alternate configuration in accordance with an embodiment of the present invention.

FIG. 9 shows a detailed perspective view of a lower side 15 of a shredder housing 12 with a sliding closure 70 of alternate configuration in accordance with an embodiment of the present invention. Closure 70 comprises a door 72 mounted with respect to tracks of guide frame 23 extending on either side of at least the output opening. Door 72 is constructed to slide between a first and second end adjacent the tracks of guide frame 23 to an open and closed position. As shown in FIG. 9, door 72 is in a closed position. Closure 70 also comprises an actuator in the form of a plurality of hinged flaps 74 and back end devices 80. Back end devices 80 are associated with each flap 74. Although two hinged flaps 74 and devices 80 are shown, the number of flaps/devices 80 used with closure 70 should not be limited. For example, in an embodiment, one or more flaps may be provided. Additionally, the size, shape, or dimension of the flaps used with the closure 70 should not be limiting.

Hinged flaps 74 are connected at one end to an underside 73 of the door 72. The hinged flaps 74 comprise torsion springs 78 about their pivot axles 76. The torsion springs 78 are constructed such that the springs are torsioned to direct the flaps 74 in a clockwise direction, as indicated by arrow H in FIGS. 9 and 10*c*, toward the underside 73 of the door 72. When the hinged flaps 74 are rotated upwardly, at least a small contact portion 82 of the flaps 74, as shown in FIGS. 10*d* and 10*e*, may extend into the inside 29 of shredder housing 12. Each contact portion 82 of the flaps 74 may be used to assist supplying rotation to hinge flaps 74 to rotate the hinges in a counter-clockwise or downward direction (i.e., opposite of arrow H), as will be further described below.

Back end devices 80 are designed to assist in both holding at least a portion of the backside or back edge of the waste container 19 when the container 19 is inserted into the secondary housing or frame 18 and to push the waste container 19 into the frame 18. In an embodiment, back end devices 80 may comprise a removable connection device, such as a magnet 32 to connect to a magnetizable element 34 located on the backside of the container 19, for example.

Figure 10B:
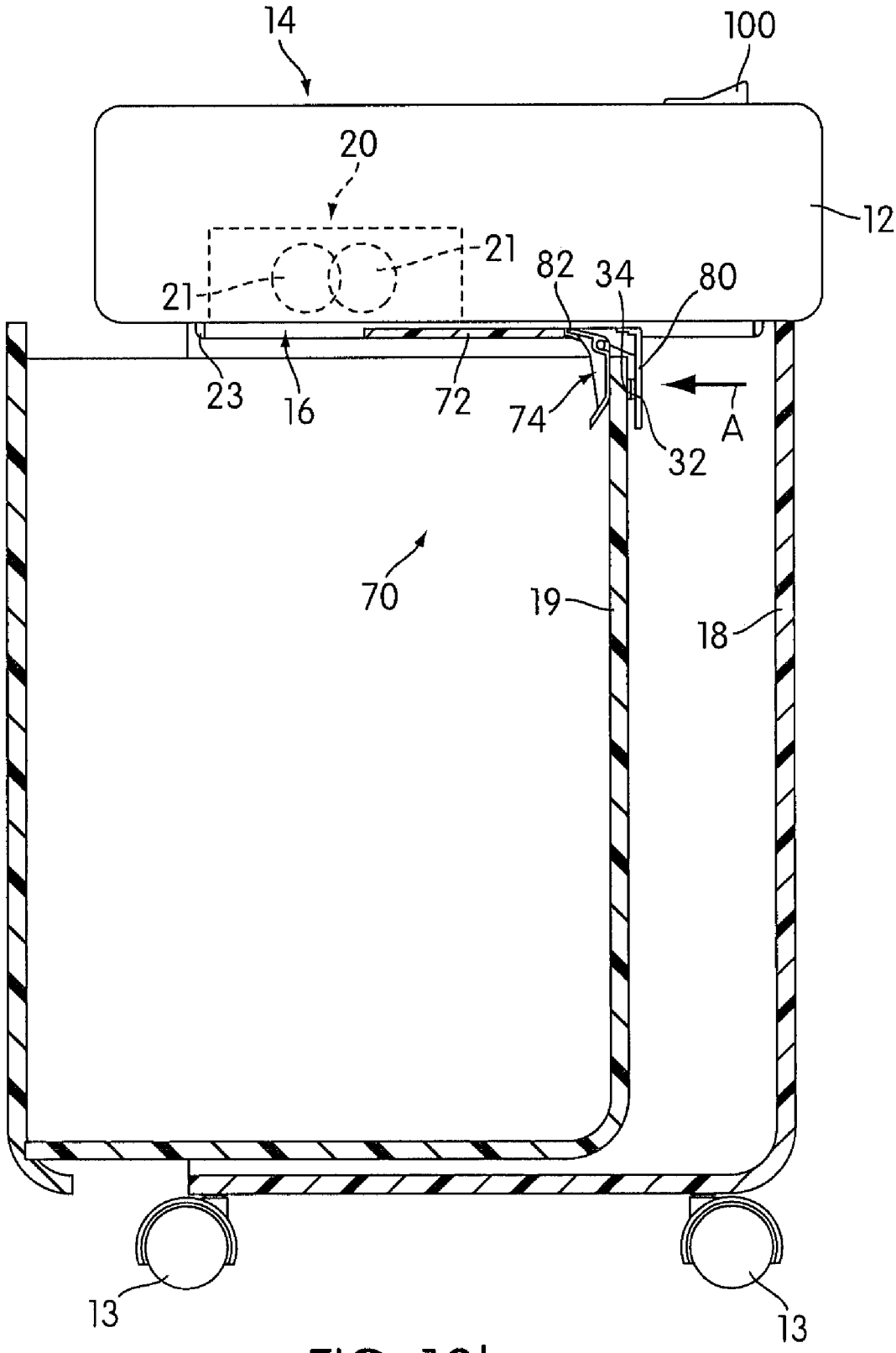
Figure 10C:
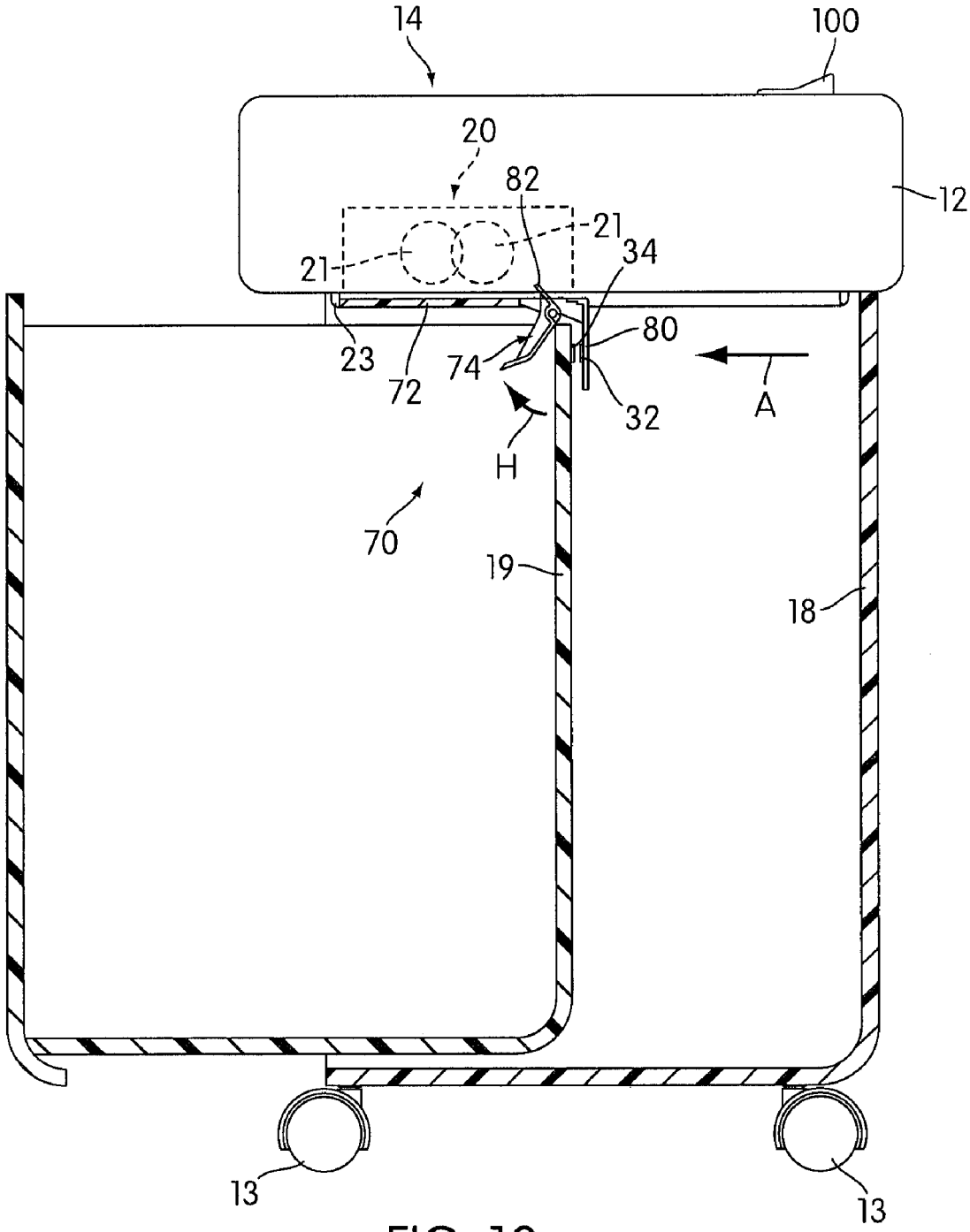
Figure 10D:
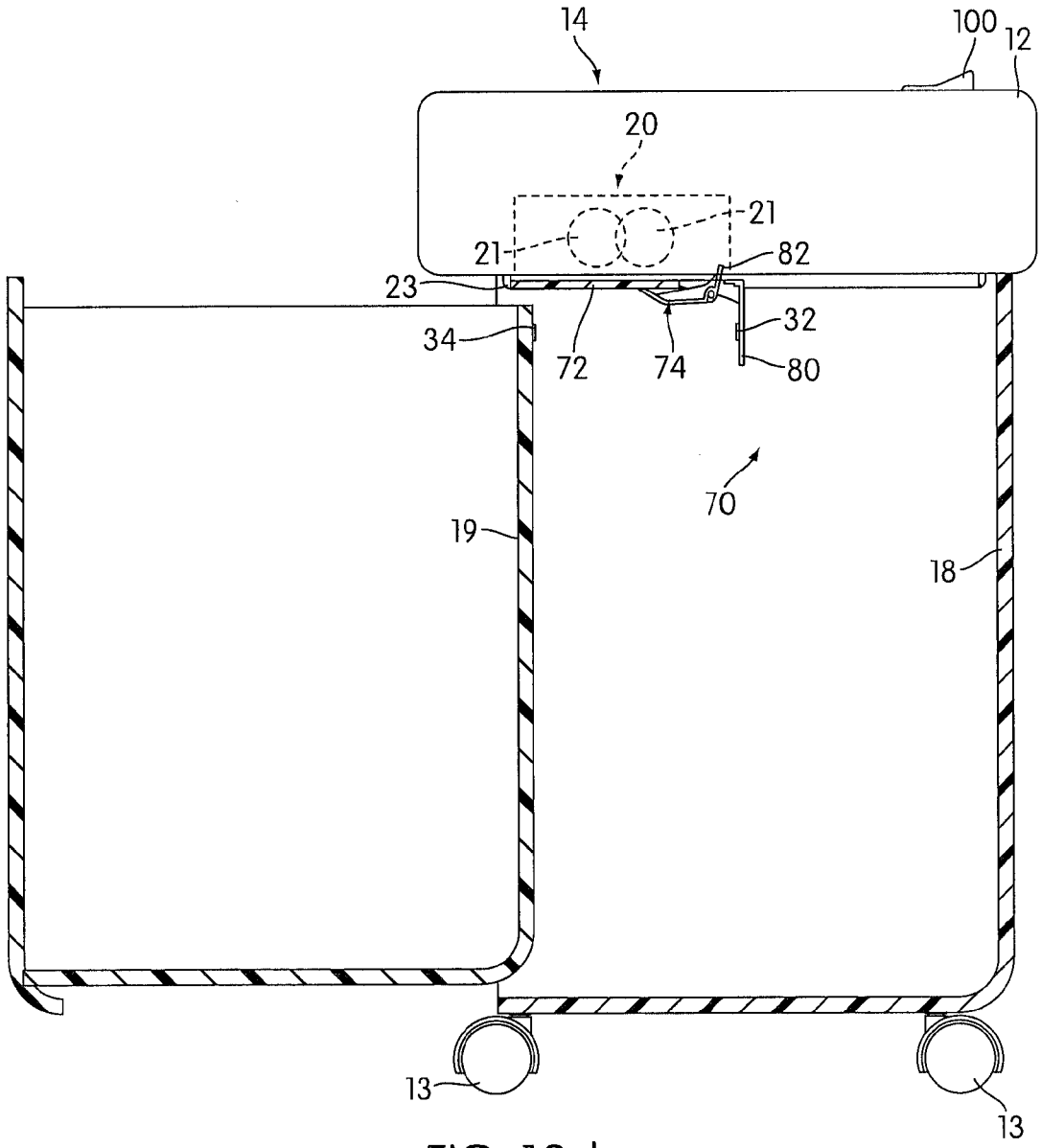
Figure 10E:
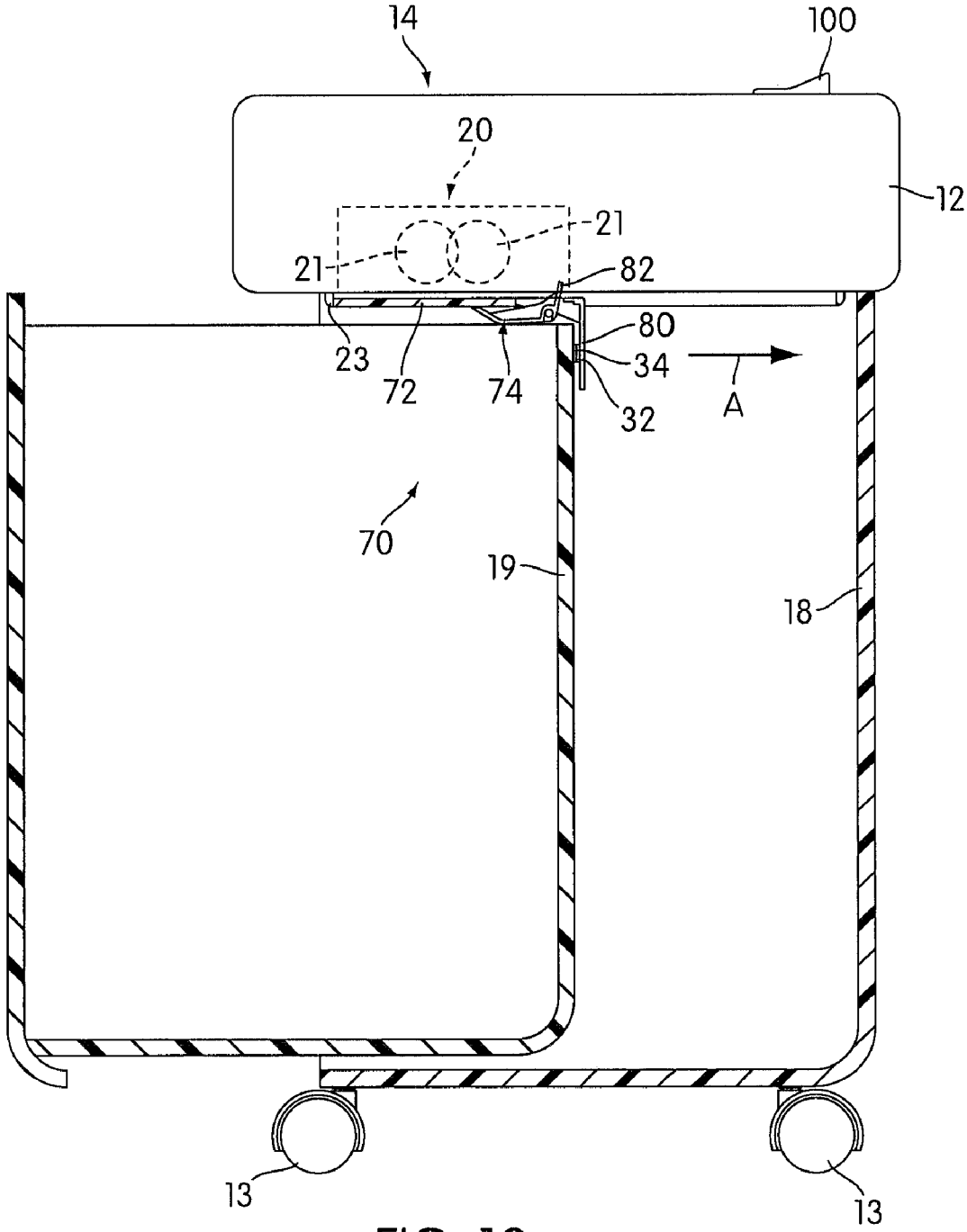
Figure 10F:
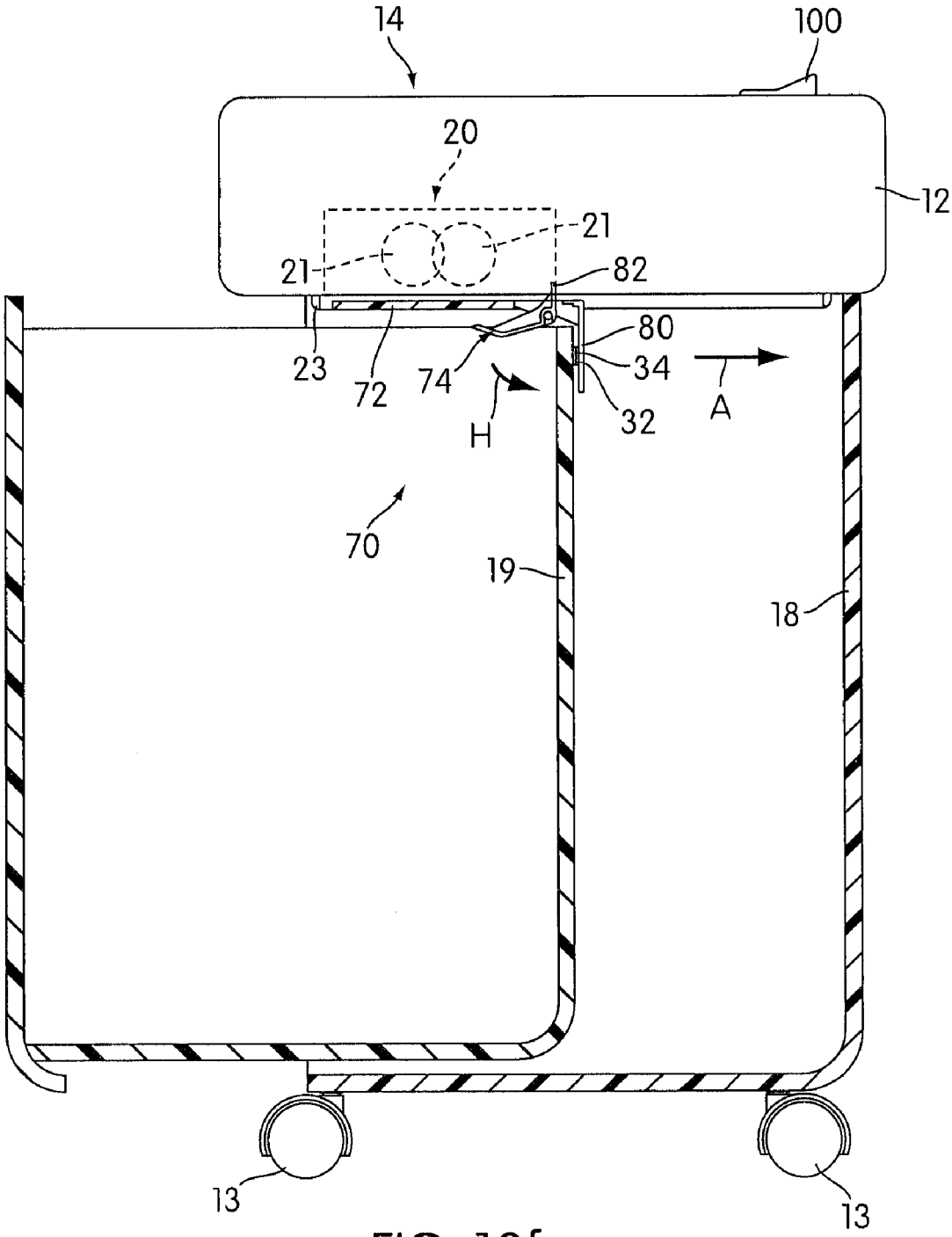

The use and activation of closure 70 is further depicted in FIGS. 10*a*-10*f*. FIG. 10*a* shows the shredder in an operative position. As shown, when the container 19 is fully inserted into frame 18, the door 72 is in a first, open position allowing shredded materials to be discharged from the output opening 18. The flaps 74 are directly downwardly (toward the bin or container) to hold or pinch at least a part of the back of the container 19 between the surfaces of the flaps 74 and the surfaces of the back end devices 80. As a user begins to remove the container 19, as shown in FIG. 10*b*, the door 72 substantially covers the output opening 16 to a second, closed position. The backside of container 19 then pushes on the backside of flaps 74. Though the container 19 continues to push on the flaps 74, the flaps 74 have not begun to rotate about their axles 76, because the contact portion 82, remains in contact with the lower side 15 of the housing 12 that is adjacent the output opening 16. That is, the shredder housing 12/output opening 16 serves as a cam surface whose contour the contact portions 82 of flaps 74 follow as the door 72 moves between the first, open position and the second, closed position.

However, as the container 19 is pulled further from the inside of frame 18, the contact portions 82 of the flaps 74 begins to follow the contour of output opening 16 of the shredder housing 12. At this point, the springs 78 of the flaps 74 will have sufficient torque to push the door 72 into a fully closed position at the second end, and thus rotate about their pivot axles 76 in direction H, releasing their grasp on the container 19. The container 19 is then released and free to be moved from beneath the shredder housing 12 to a withdrawn position, as shown in FIG. 10*d*. Door 72 is in a closed position.

When the container 19 is reinserted into frame 18, at least a portion of the backside of container 19 pushes on the back end devices 80 of the actuator of the closure 70 as shown in FIG. 10*e*. As the container 19 is pushed further in, the contact portions 82 of the flaps 74 follow the cam surface within the output opening 16 and, when contacted by the edge, the flaps 74 are rotated downwardly (in an opposite direction) so that the backside of the container 19 is held between the side of the flaps 74 and the back end devices 80.

Each of the embodiments of the closures described herein are used in cooperation with a door or flap to cover at least a portion of the output openings 16 of shredder housings 12 to prevent shredded materials from being discharged therefrom. Though the noted prior art describes a flap, the flaps of the prior art are provided for safety reasons, e.g., to keep the user away from the sharp metal cutters or as a bin full method. The disclosed invention uses sliding flaps to keep particles from falling onto the ground or onto the cabinet floor. Furthermore, the disclosed invention uses a mechanically activated flap to assist in collecting any shredded material that may be discharged from a shredder mechanism 20 or cutter elements 21 so that the user or consumer is prevented from having the burden to collect shredded materials when the waste container 19 is removed from the frame 18 and emptied.

While the principles of the invention have been made clear in the illustrative embodiments set forth above, it will be apparent to those skilled in the art that various modifications may be made to the structure, arrangement, proportion, elements, materials, and components used in the practice of the invention.

For example, the type of shredder 10 that closure is applied to should not be limiting. The shredder 10 may comprise a shredder mechanism 20 and cutter elements 21 many configurations. The above mechanism may be implemented in all cross cut machines and strip cutting machines.

It is envisioned that, in some embodiments, the closure may be hingeably connected to shredder housing or container. Alternatively, the closure may provide a combination of being both pivotable and slidable with respect to the output opening of the shredder housing.

Also, the embodiments above generally describe the movement or sliding of the closure (door) as being actuated by the actuator when the waste container 19 of the shredder 10 is pulled out of an operative position relative to the shredder housing 12 or shredder mechanism 20 to a withdrawn position. However, as mentioned, there are many different methods to actuate the actuator. For example, the closure may be applied to shredders comprising lift-off shredder housings, wherein, when the frame 18 and shredder housing 12 are moved out of operative position relative to each other, i.e., when the shredder housing 12 is lifted off of the frame 18, the actuator moves the closure to a closed position. Thus, the closure prevents shredded materials from being discharged from the output opening 16.

Though a more economical method would be to use a mechanical, non-motorized, non-sensor activated method, generally, any method used to actuate an actuator to close a door or flap of the closure on the underside of the shredder housing 12 so that waste particles/shredded materials do not escape or discharge and cause an annoying mess during the waste bin emptying process may be envisioned. Such actuators or activators do not require orientation of the shredder housing in a particular orientation to cause gravity to drop the closure over the output opening 16 (e.g., such as shown in the patent mentioned above), and instead operate to close the shredder in response to a predetermined operational condition of the shredder, as described herein. That is, such actuators are not passively dependent on the orientation of the shredder housing, and instead may function independently of the shredder housing's orientation.

Additionally, though the embodiments of the closure described herein are generally mechanically activated by mechanical devices, the actuation of the closure as disclosed herein should not be limited to such. For example, the closure may be used in cooperation with one or more sensor devices. Such sensor devices may include devices that are capable of, but not limited to, bin full indicators, detecting movement of the waste bin, detecting shredded materials located in or around the output opening, detecting power or whether the shredder mechanism is switched on or off, and/or detecting and indicating that the output opening is closed. The closure may also be used with any electromechanical, electric, or electronic devices. For example, a motor may be activated by a switch to direct or assist in directing the closure to a closed position before the bin is removed. Also, sensor devices may be used in cooperation with any number of mechanical, electromechanical, or electric devices.

Devices may be used to determine if waste bin can be removed. For example, in an embodiment, in order to remove waste bin, the rotation of cutting elements 21 and power to shredder mechanism 20 must be limited or stopped. As another example, movement of the waste container 19 may trigger a switch to turn the power off of the shredder 10 thereby stopping the cutter elements 21 from rotating and assisting in reducing a mess caused by shredded materials.

It should be noted that the waste container 19 need not be entirely removed from the frame 18. For example, as the user pulls the container 19, the guide frame 23 may assist in stopping the user from removing the container 19 in its entirety. Alternatively, devices, such as hinged flaps 74 and back end devices 80, may be provided in correlation with the closure or shredder housing 12 to prevent a user or consumer from removing the container 19 entirely.

Also, it should be noted that the method of removably connecting the actuator of the closure should not be limited to the above described embodiments. For example, referring to FIGS. 2 and 3, the location of the magnet 32 on the extension flap 30 may be adjusted. In FIGS. 2 and 3, the magnet 32 is provided on a side of the flap 30 facing an outward direction, toward the backside of the container 19. In an embodiment, the magnet 32 may be provided on a side of the flap 30 facing inwardly, i.e., toward the inner side of the back of the frame 18. Thus, when a user pulls the container 19 to the second end of guide frame 23, the container 19 is stopped. The user may then manipulate the container 19 (e.g., slightly push the bin into the frame 18 and then angle the container 19 to completely remove it) so as to break the magnetic connection and ease emptying of the contents therein.

Additionally, the resilient mechanisms used with the closure should not be limiting. For example, in some embodiments, the actuators comprise torsion springs which are generally noted as being used with at least one pivotable member configured to rotate about a pivot point with respect to the closure. However, alternative resilient mechanisms, such as tension springs, may be used with the actuators to assist in actuating movement of the closure, and therefore such devices should not be limited.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder comprising:

a container for receiving shredded materials;

a shredder mechanism including a motor and cutter elements, the shredder mechanism enabling materials to be shredded to be fed into the cutter elements and the motor being operable to drive the cutter elements in a shredding direction so that the cutter elements shred materials fed therein;

a shredder housing having the shredder mechanism mounted therein;

the shredding housing comprising an input opening on an upper side for receiving materials to be shredded into the shredder mechanism, and an output opening on a lower side for discharging shredded materials from the shredder mechanism;

the shredder housing being configured to be supported above the container such that the shredded materials are discharged through the output opening into the container;

a rolling closure located adjacent the output opening and including a flexible panel and a storage device for receiving the flexible panel in a rolled condition, the rolling closure being configured to enable the panel to be selectively unrolled about an axis and extended from the storage device to a closed position and rolled about the axis and retracted to the storage device to an open position, respectively;

the rolling closure allowing shredded materials to be discharged from the output opening in the open position and preventing shredded materials from being discharged from the output opening in the closed position; and an actuator for moving the rolling closure to the closed position in response to a predetermined operational condition of the shredder.

2. A shredder according to claim 1, wherein the predetermined operational condition of the shredder is the container and the shredder housing being moved out of an operative position relative to each other.

3. A shredder according to claim 2, wherein the rolling closure is moved to the closed position in a direction parallel to a direction for moving the container from its operative position.

4. A shredder according to claim 3, further comprising a guide frame, the guide frame positioned adjacent the output opening and configured to guide the interconnected slats of the rolling closure's flexible panel when moved between the open position and the closed position.

5. A shredder according to claim 2, wherein the actuator is constructed to move the closure to the closed position in response to disengagement of the container and the shredder housing.

6. A shredder according to claim 2, wherein the closure is connected to the shredder housing.

7. A shredder according to claim 2, wherein the shredder further comprises a frame on which the shredder housing is mounted, the frame defining a waste container receiving space beneath the shredder housing, the waste container receiving space being configured to allow the waste container from an operative position beneath the shredder housing for receiving shredder materials discharged from the output opening, to a withdrawn position moved out from beneath the shredder housing for emptying of the shredded materials therein, wherein the actuator is constructed to be actuated to move the closure to the closed position responsive to the waste container being moved to the withdrawn position.

8. A shredder according to claim 7, wherein an engagement part is connected to the closure and positioned to be removably engaged by the waste container as the waste container is being moved into the operative position such that the engagement part is moved to move the closure to the open position.

9. A shredder according to claim 8, wherein the engagement part and the waste container comprise a pair of magnets or a magnet and a magnetizable element positioned to maintain the removable engagement between the engagement part and the waste container as the waste container is being moved the withdrawn position such that the engagement part is moved to move the closure to the closed position.

10. A shredder according to claim 1, wherein the flexible panel of the rolling closure comprises a plurality of interconnected slats, wherein the interconnected slats are configured to cover the output opening in the closed position, and wherein at least a portion of the interconnected slats are rolled up for storage by the storage device in the open position.

11. A method for preventing shredded materials from being discharged from an output opening of a shredder, the shredder comprising a container for receiving shredded materials; a shredder housing supported above the container and having a shredder mechanism mounted therein, the shredder mechanism comprising an input opening on an upper side for receiving materials to be shredded and the output opening on a lower side for discharging shredded materials into the container; the shredder further comprising a rolling closure located adjacent the output opening and including a flexible panel and a storage device for receiving the flexible panel in a rolled condition, the rolling closure being configured to enable the panel to be selectively unrolled about an axis and extended from the storage device to a closed position and rolled about the axis and retracted to the storage device to an open position, respectively, the method comprising:

unrolling the flexible panel of the rolling closure about the axis from the storage device with an actuator from the open position to the closed position in response to a predetermined operational condition of the shredder, wherein the rolling closure allows shredded materials to be discharged from the output opening in the open position and prevents shredded materials from being discharged from the output opening in the closed position.

12. A shredder comprising:

a container for receiving shredded materials;

a shredder mechanism including a motor and cutter elements, the shredder mechanism enabling materials to be shredded to be fed into the cutter elements and the motor being operable to drive the cutter elements in a shredding direction so that the cutter elements shred materials fed therein;

a shredder housing having the shredder mechanism mounted therein;

the shredding housing comprising an input opening on an upper side for receiving materials to be shredded into the shredder mechanism, and an output opening on a lower side for discharging shredded materials from the shredder mechanism;

a frame supporting the shredder housing above the container such that the shredded materials are discharged through the output opening into the container, the frame defining a waste container receiving space beneath the shredder housing, the waste container receiving space being configured to allow the container to be moved in a first direction between an operative position positioned in the frame beneath the shredder housing and a withdrawn position moved out from beneath the shredder housing for emptying of the shredded materials therein;

a closure located adjacent the output opening, the closure being configured to slide relative to the output opening between an open position and a closed position in a second direction generally perpendicular to the first direction;

the closure allowing shredded materials to be discharged from the output opening in the open position and preventing shredded materials from being discharged from the output opening in the closed position; and an actuator for sliding the closure to the closed position in response to the container being moved out of the operative position.

13. A shredder according to claim 12, wherein the actuator comprises an actuation arm and a spring actuated device for selectively sliding the closure at least from the open position to the closed position.

14. A shredder according to claim 12, wherein the actuator is constructed to slide the closure in the second direction to the closed position in response to the container being withdrawn from the waste container receiving space in the first direction.

15. A shredder according to claim 12, wherein the closure is connected to the shredder housing.

16. A shredder according to claim 13, wherein the actuation arm is connected to the closure, and wherein the actuation arm is positioned to be engaged by the container (a) when the container is moved in the first direction to slide the closure to the closed position and (b) when the container is moved to the operative position to slide the closure to the open position.

17. A method for preventing shredded materials from being discharged from an output opening of a shredder, the shredder comprising a container for receiving shredded materials; a shredder housing supported above the container by a frame and having a shredder mechanism mounted therein, the shredder mechanism comprising an input opening on an upper side for receiving materials to be shredded and the output opening on a lower side for discharging shredded materials into the container; the frame defining a waste container receiving space beneath the shredder housing, the waste container receiving space being configured to allow the container to be moved in a first direction between an operative position positioned in the frame beneath the shredder housing and a withdrawn position moved out from beneath the shredder housing for emptying of the shredded materials therein; a closure located adjacent the output opening, the closure being configured to slide relative to the output opening between an open position and a closed position in a second direction generally perpendicular to the first direction, the method comprising:

moving the container in the first direction; and sliding the closure in the second direction from an open position to a closed position in response to the container being moved out of the operative position, wherein the closure allows shredded materials to be discharged from the output opening in the open position and prevents shredded materials from being discharged from the output opening in the closed position.

* * * * *